US008774649B2

(12) United States Patent
Fukuda et al.

(10) Patent No.: US 8,774,649 B2
(45) Date of Patent: Jul. 8, 2014

(54) IMAGE FORMING APPARATUS

(75) Inventors: Tadashi Fukuda, Toride (JP); Shinya Suzuki, Abiko (JP); Takuya Hori, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 13/285,351

(22) Filed: Oct. 31, 2011

(65) Prior Publication Data

US 2012/0106991 A1 May 3, 2012

(30) Foreign Application Priority Data

Nov. 2, 2010 (JP) ..... 2010-246517

(51) Int. Cl.
*G03G 15/08* (2006.01)

(52) U.S. Cl.
USPC ..... 399/27

(58) Field of Classification Search
USPC ..... 399/9, 24–30, 53, 58–65
See application file for complete search history.

(56) References Cited

U.S. PATENT DOCUMENTS

| | | | | |
|---|---|---|---|---|
| 7,551,864 | B2 | 6/2009 | Fujimori et al. | |
| 7,697,854 | B2 | 4/2010 | Itoyama et al. | |
| 7,860,415 | B2 * | 12/2010 | Tokuyama et al. | 399/62 |
| 8,249,481 | B2 * | 8/2012 | Takenouchi et al. | 399/74 |
| 2007/0122171 | A1 | 5/2007 | Fujimori et al. | |
| 2008/0219684 | A1 | 9/2008 | Itoyama et al. | |
| 2011/0262161 | A1 | 10/2011 | Fukuda et al. | |

FOREIGN PATENT DOCUMENTS

| | | | |
|---|---|---|---|
| JP | 2001-13742 | A | 1/2001 |
| JP | 2004-205708 | A | 7/2004 |
| JP | 2004-361511 | A | 12/2004 |
| JP | 2007-148134 | A | 6/2007 |
| JP | 2008-216816 | A | 9/2008 |

* cited by examiner

*Primary Examiner* — Hoan Tran
(74) *Attorney, Agent, or Firm* — Fitzpatrick, Cella, Harper & Scinto

(57) ABSTRACT

An image forming apparatus includes an image forming portion for forming an image on a recording material, a sensor to detect a toner image formed by the image forming portion, and a correcting portion to correct an image forming condition of the image forming portion on the basis of a result of detection, by the sensor, of a first control toner image formed by the image forming portion. In addition, a supply controller controls a developer supplying operation on the basis of a result of detection, by the sensor, of a second control toner image formed by the image forming portion. A controller controls an image forming condition such that the first control toner image is formed at the image forming speed of a second image forming mode, and the second control toner image is formed after the image forming speed is changed to a third image forming speed which is higher than the second image forming speed.

4 Claims, 9 Drawing Sheets

IMAGE FORMING APPARATUS

FIELD OF THE INVENTION AND RELATED ART

The present invention relates to an image forming apparatus capable of independently adjusting the condition under which it forms images, and the amount of toner charge, from each other, with the use of a test-patch (toner image) formed for the adjustment. More specifically, it is related to a method for controlling an image forming apparatus to reduce the apparatus in the length of time it requires to adjust the amount of toner charge with the use of a test-patch (toner image).

Image forming apparatuses which form an electrostatic image on their image bearing member, develop the electrostatic image by making their developer bearing member bear developer (mixture of toner and carrier), transfer the developed electrostatic image (visible image formed of toner) onto a sheet of recording medium, and thermally fix the developed latent image on the sheet of recording medium with their fixing device have been widely in use. Some of the image forming apparatuses of this type are capable of carrying out a sequence for automatically adjusting the amount by which their developing device is replenished with toner, in order to keep the developer in their developing device stable in the amount of electrostatic charge (so-called patch-detection ATR in Japanese Laid-open Patent Application 2004-205708).

The image forming apparatus disclosed in Japanese Laid-open Patent 2004-205708 is equipped with a developer dispensing device of the so-called video-count type. The amount by which the developer dispensing device replenishes the developing device of the apparatus with toner is adjusted based on the amount of the toner in a test-patch, which is detected by the optical sensor of the image forming apparatus. More concretely, a test-patch (toner image) is formed on the photosensitive drum with a preset frequency, and the amount of the toner in the test-patch is detected by the optical sensor. Then, the amount by which the developer dispensing device replenishes the developing device with toner is adjusted based on the detected amount of the toner in the test-patch, so that the developing device is kept stable in the amount of electrostatic toner charge. Therefore, this image forming apparatus is excellent in the reproducibility in terms of the amount by which toner is adhered to an electrostatic image, that is, image density.

However, even when the image forming apparatus is kept stable in the amount of toner charge the image forming apparatus is significantly reduced in the reproducibility of the image density if the ambience in which an image forming apparatus is operated changes in temperature and humidity. As one of the solutions to this problem, a method for controlling an image forming apparatus to readjust the electrostatic image formation condition, as necessary, has been put to practical use. More specifically, two or more test-patches (toner images) are formed on an image bearing member under two or more electrostatic image formation conditions, and the amount of the toner in each test-patch is detected by a detecting means. Then, the electrostatic image formation condition is adjusted as necessary based on the detected amount of the toner in one of the test-patches formed under the different condition (Japanese Laid-open Patent Application 2007-148134).

Japanese Laid-open Patent Application 2007-148134 discloses an image forming apparatus enabled to operate in the normal mode for forming an image on a sheet of ordinary paper, or the low speed mode for forming a sheet of thick paper, such as cardboard, which is rather difficult for a toner image to be thermally fixed to. In the case of this image forming apparatus, if an image forming operation which is being carried out in the low speed mode is interrupted by the control sequence which adjusts the image forming apparatus in the electrostatic image formation condition by forming a test-patch (toner image), the image forming apparatus is switched in image formation speed from the one for the low speed mode to the one for the normal one, before the control sequence is carried out.

However, the method disclosed, as the means for adjusting an image forming apparatus in the electrostatic image formation condition, in the Japanese Laid-open Patent Application 2007-148134 is problematic in that it is rather large in the amount of adjustment error. That is, the formation and transfer of a test-patch (toner image) is affected by the image formation speed. For example, development efficiency and transfer efficiency are affected by the image formation speed. Thus, the results of the measurement of the amount of the toner in a test-patch (toner image) formed in the normal image formation speed is not good enough for properly adjusting an image forming apparatus in the electrostatic image formation condition for the low speed mode.

Thus, the following modification for the above described control method has been proposed. That is, when an image forming apparatus is being operated in the low speed mode, a test-patch (toner image) is formed in the image formation speed for the low speed mode, and the necessary control is carried out based on the testing of the thus formed test-patch, whereas when the image forming apparatus is being operated in the normal mode, a test-patch (toner image) is formed in the image formation speed for the normal mode, and the necessary control is carried out.

However, this modification also is problematic for the following reason. That is, as the control sequence for adjusting an image forming apparatus in the amount of toner charge interrupts an image forming operation, the image forming apparatus cannot form the intended images while it forms a test-patch (toner image), conveys the test-patch to its detecting means, and detects the amount of the toner in the test-patch. Therefore, if the image forming apparatus is operated in the image forming speed for the low speed mode, the length of the downtime, that is, the length of time necessary for the control, is significant. In other words, the above-descried modification significantly increases the length of time necessary to complete an image forming operation which is to be carried out in the low speed mode.

SUMMARY OF THE INVENTION

Thus, the primary object of the present invention is to provide an image forming apparatus which is significantly shorter in the downtime attributable to the formation of a toner image (test-patch) for controlling the apparatus in the image formation condition, and yet, no lower in the accuracy with which the image formation condition is adjusted, than any image forming apparatus in accordance with the prior art.

According to an aspect of the present invention, there is provided an image forming apparatus comprising an image forming portion for forming an image on a recording material, said image forming portion including a developing device for developing an electrostatic image formed on an image bearing member using a developer containing toner and a carrier; a sensor for detecting a toner image formed by said image forming portion; a correcting portion for correcting an image forming condition of said image forming portion on the basis of a result of detection, by said sensor, of a first control toner image formed by said image forming portion; a supplying device for supplying the developer to said developing device; a supply controller for controlling a supplying operation of said supplying device on the basis of a result of detection, by said sensor, of a second control toner image formed by said image forming portion; an executing portion for executing an operation at least in a first image forming mode in which the image is formed at a first image forming speed and in a second image forming mode in which the image is formed at a second image forming speed; and a controller for controlling an image forming condition such that during execution of the operation at least in the second image forming mode, the first control toner image is formed at the image forming speed of the second image forming mode, and the second control toner image is formed after the image forming speed is changed to a third image forming speed which is higher than the second image forming speed.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Figure 1:
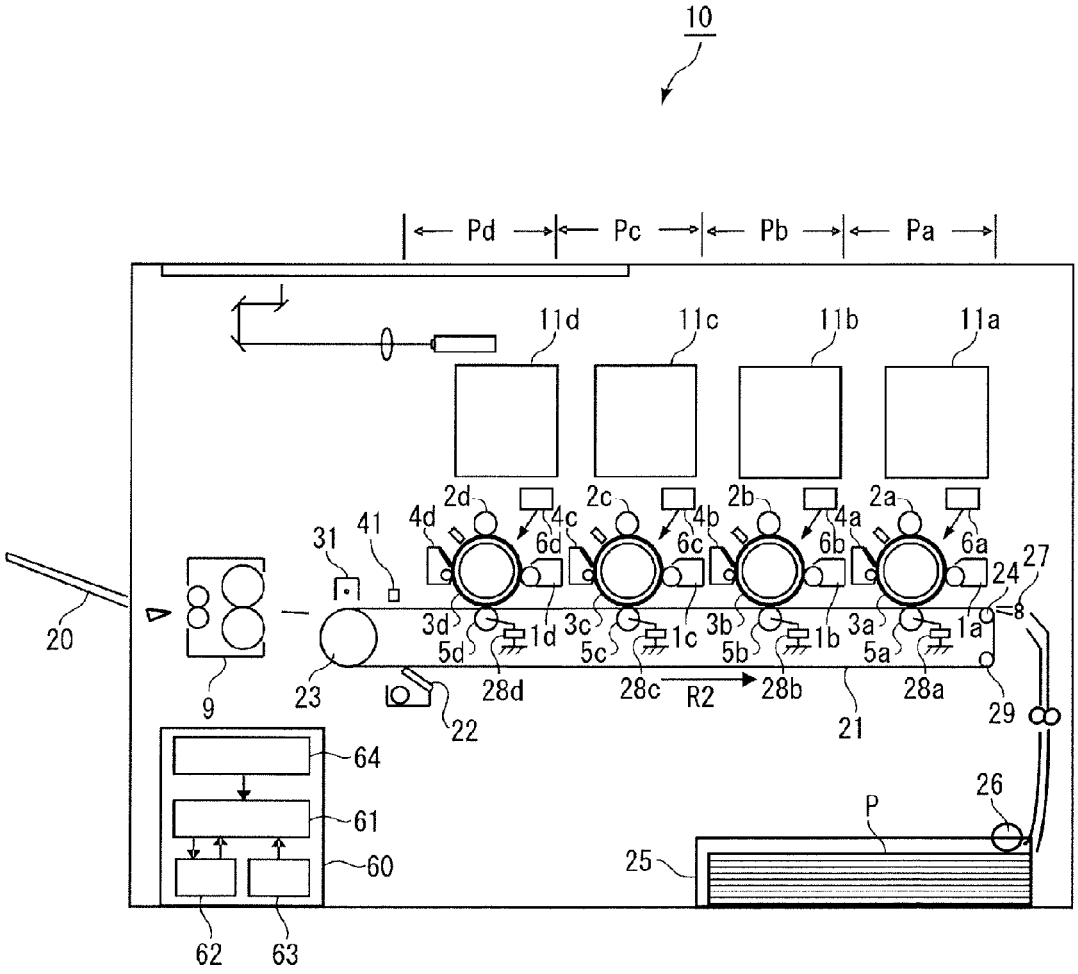
FIG. 1 is a schematic sectional view of the image forming apparatus in the first preferred embodiment of the present invention, and shows the structure of the apparatus.

Hereinafter, the preferred embodiments of the present invention are described in detail with reference to the appended drawings. The present invention is compatible with image forming apparatuses other than those in the following preferred embodiments of the present invention, as long as the other image forming apparatuses interrupt a continuous image forming operation to carry out the so-called patch detection ATR control (automatic tone replenishment), and increase themselves in image formation speed before they actually carry out the patch detection ATR control, even if they are partially or entirely different in structure from those in the preferred embodiments, but, are the same in function.

That is, not only is the present invention compatible with an image forming apparatus (such as the image forming apparatus in FIG. 7) which employs an intermediary transferring member, but also, with an image forming apparatus (such as image forming apparatus in FIG. 1) which employs a recording medium conveying member. That is, the present invention is compatible with any image forming apparatus as long as the apparatus uses two-component developer, regardless of whether it is of the so-called tandem type or the so-called single drum type, whether it is for forming a monochromatic, transparent, multicolor, or full-color image, and regardless of charging method, exposing method, image transfer structure, presence or absence of a drum cleaning device, or the like. In the following description of the preferred embodiments of the present invention, it is only the essential portions of the image forming apparatus, which are related to image formation and image transfer, which are described. However, the present invention is compatible with various image forming apparatuses such as printers, facsimile machines, multifunction printers, etc., which comprise: the portions which will be described next; and additional devices, equipments, containers (shells) which are necessary for their specific usages.

Incidentally, the items of the image forming apparatuses disclosed in Japanese Laid-open Patent Applications 2004-205708 and 2007-148134, which are not directly related to the present invention, are not shown in the drawings, and are not going to be described in this specification.

<Image Forming Apparatus>

FIG. 1 is a schematic sectional view of an example of an image forming apparatus to which the present invention is applicable. It shows the general structure of the apparatus. Referring to FIG. 1, the image forming apparatus 10 is a full-color printer of the tandem type. It employs a recording medium conveying means. More specifically, it has a recording medium conveyance belt 21, and four image forming stations P, which are yellow, magenta, cyan, and black image forming stations Pa, Pb, Pc, and Pd. The four image forming stations P are sequentially arranged in the listed order along the recording medium conveyance belt 21.

As a sheet P of recording medium in a recording medium cassette 25 is moved out of the cassette 25 by a separation roller 26 while being separated from the rest of the sheets P in the cassette 25, it is conveyed to a pair of registration rollers 27, which releases the sheet P to the recording medium conveyance belt 21 in synchronism with the timing with which a toner image is formed in the image forming station Pa.

In the image forming station Pa, a yellow toner image is formed on a photosensitive drum 3*a*, and transferred onto the sheet P of recording medium on the recording medium conveyance belt 21. This process of transferring the toner image onto the sheet P causes the sheet P to be electrostatically held to the recording medium conveyance belt 21.

In the image forming stations Pb, a magenta toner image is formed on a photosensitive drum 3*b*, and transferred onto the sheet P on the recording medium conveyance belt 21. In the image forming stations Pc and Pd, cyan and black toner images are formed on photosensitive drums 3*c* and 3*d*, respectively, and are transferred on to the sheet P on the recording medium conveyance belt 21.

After the toner images, different in color, are transferred in layers onto the sheet P, the sheet P is conveyed by the rotation of the recording medium conveyance belt 21 to the surface of the curved portion of the recording medium conveyance belt 21, where static charge is removed from the sheet P by a charging device 31 for separating the sheet P from the recording medium conveyance belt 21. As the static charges, by which the sheet P has been held to the recording medium conveyance belt 21, is removed from the sheet P, the sheet P is separated from the recording medium conveyance belt 21 by the curvature of the recording medium conveyance belt 21, and is led to a fixing device 9.

In the fixing device 9, the sheet P and the toner images thereon are subjected to heat and pressure by the fixing device 9. Thus, the toner images become fixed to the sheet P. Then, the sheet P is discharged into a delivery tray 20 structured so that as a sheet P of recording medium is discharged into the tray 20, it is laid on the stack of preceding sheets P in tray 20.

The image forming stations Pa, Pb, Pc, and Pd are roughly the same in structure, although they are different in the color of the toner which their developing devices 1*a*, 1*b*, 1*c*, and 1*d*, respectively, use. Hereafter, therefore, only the image forming station Pa is described, since the description of the image forming stations Pb, Pc, and Pd are the same except for the suffixes with which the referential codes are provided to indicate the specific image forming station to which the structural components belong.

The image forming station Pa has a photosensitive drum 3*a*. It has also a charge roller 2*a*, an exposing device 6*a*, a developing device 1*a*, a primary transfer roller 5*a*, and a drum cleaning device 4*a*, which are in the adjacencies of the peripheral surface of the photosensitive drum 3*a*, and are in the listed order. The photosensitive drum 3*a* is made up of an aluminum cylinder, and a photosensitive layer on the peripheral surface of the aluminum cylinder. The photosensitive drum 3*a* is rotated at a preset peripheral velocity (process speed). The charge roller 2*a* negatively and uniformly charges the peripheral surface of the photosensitive drum 3*a* to a preset potential level VD, that is, the pre-exposure potential level of the uniformly charged area of the peripheral surface of the photosensitive drum 3*a*.

The exposing device 6*a* (laser scanner) writes an electrostatic image on the uniformly charged portion of the peripheral surface of the photosensitive drum 3*a*, by scanning the uniformly charged portion with the beam of layer light which it projects while modulating the beam with the electrical signals obtained from the yellow monochromatic image, that is, one of the monochromatic images into which an image to be formed was separated. The developing device 1*a* develops the electrostatic image on the peripheral surface of the photosensitive drum 1 into a visible image, that is, an image formed of toner, which hereafter will be referred to simply as a toner image. The developer is made up of toner and carrier.

The primary transfer roller 5*a* forms the primary transfer station between the peripheral surface of the photosensitive drum 3*a* and recording medium conveyance belt 21 by being pressed on the inward surface of the recording medium conveyance belt 21. To the primary transfer roller 5*a*, a transfer voltage is applied from an electrical power source 28*a*. The polarity of the transfer voltage is the same as the polarity to which toner is intrinsically charged. As the transfer voltage is applied, the negatively charged toner image on the photosensitive drum 3*a* is transferred onto the sheet P of recording medium on the recording medium conveyance belt 21. The recording medium conveyance belt 21 is supported and kept stretched by a drive roller 23, a tension roller 24, and a tension roller 29. It rotates at a preset speed (process speed) in the direction indicated by an arrow mark R2, by being driven by the drive roller 23.

The drum cleaning device 4*a* is for recovering the transfer residual toner on the peripheral surface of the photosensitive drum 3*a*, that is, the toner which failed to be transferred onto the sheet P of recording medium 3*a* and is remaining on the peripheral surface of the photosensitive drum 3*a*. It has a cleaning blade, which is kept in contact with the peripheral surface of the photosensitive drum 3*a*. Thus, as the photosensitive drum 3*a* is rotated, the transfer residual toner on the peripheral surface of the photosensitive drum 3*a* is recovered by the cleaning blade. The belt cleaning device 22 is for recovering a test-patch (toner image) adhered to the recording medium conveyance belt 21, and also, the transfer residual toner on the recording medium conveyance belt 21, to which the formation of a foggy image is attributable. It has a cleaning blade, which is in contact with the recording medium conveyance belt 21. Thus, as the recording medium conveyance belt 21 is rotated, the test-patch, residual toner, etc., on the recording medium conveyance belt 21 are recovered by the cleaning blade.

The image forming apparatus 10 can be operated in multiple operational modes, which are different in image formation speed. That is, not only can it be operated in the normal mode, but also, in the low speed mode. The normal mode is for forming an image on recording paper, such as a sheet of recording medium used in a business office, which is ordinary in basis weight. It is the fastest mode in terms of the image formation speed. The low speed mode is the mode in which the image forming apparatus 10 is to be operated when the condition under which a toner image is to be transferred and the condition under which a toner image is to be fixed have to be different from the condition under which a toner image is formed in the normal mode and the condition under which a toner image is fixed in the normal mode. For example, it is used when an image is printed (formed) on a sheet of thick paper (cardboard or the like).

The fixing device 9 is an example of a fixing means for fixing an unfixed toner image to recording medium by heating a sheet P of recording medium and the unfixed toner image thereon after the transfer of the unfixed toner image onto the sheet P from the recording medium conveyance belt 21. The normal mode is to be used when the sheet P of recording medium is a sheet of ordinary paper, whereas the low speed mode is to be used when recording medium for an image forming operation is such a medium that is more difficult than ordinary paper in terms of image fixation.

<Developing Device>

Figure 2:
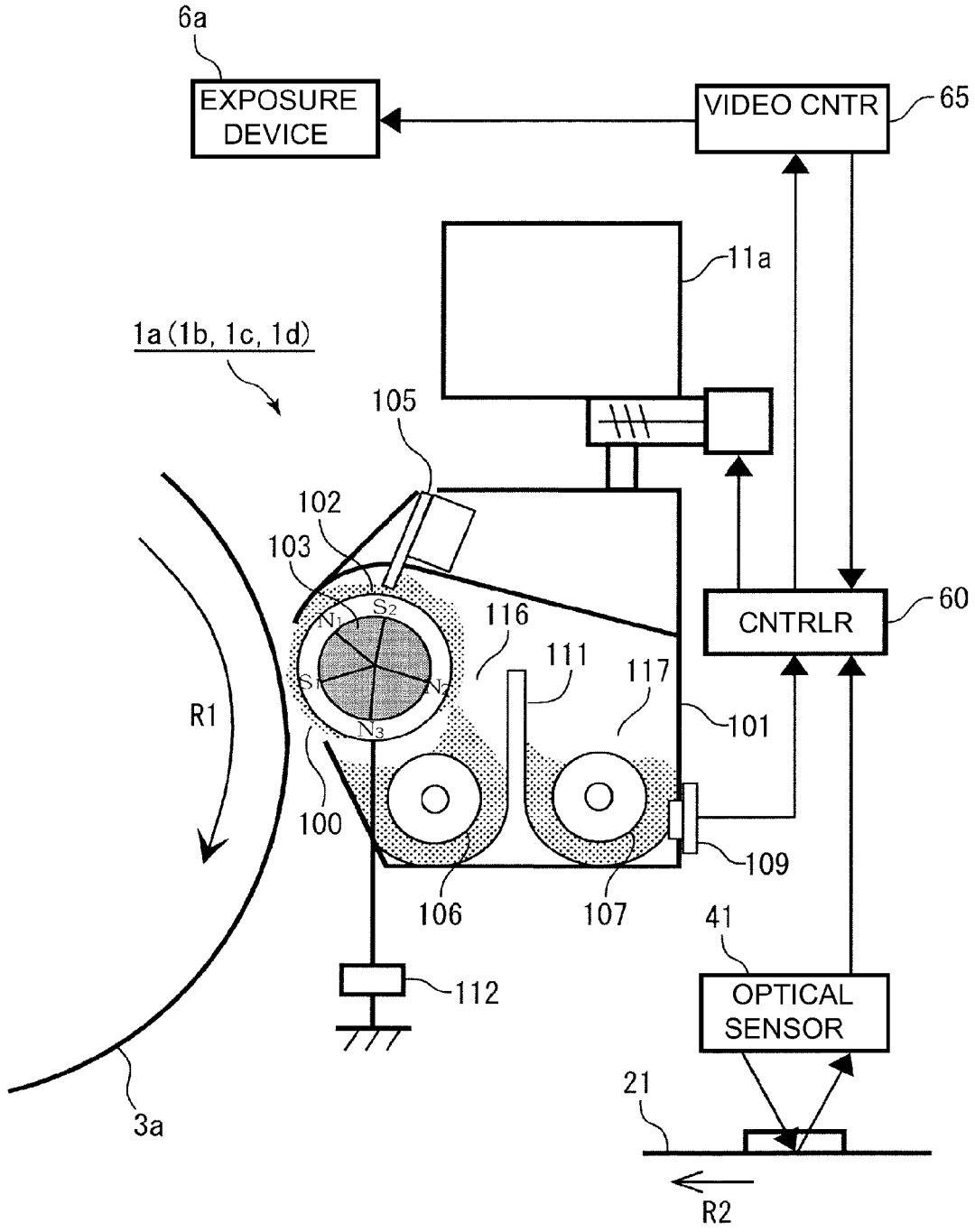
FIG. 2 is a schematic sectional view of the developing apparatus and its adjacencies in the first preferred embodiment of the present invention, and shows the structure of the developing device.

FIG. 2 is a drawing for describing the structure of the developing device 1*a*. Referring to FIG. 2, the exposing device 6*a*, which is an example of a means for forming an electrostatic image, forms an electrostatic image on the peripheral surface of the photosensitive drum 3*a*, which is an example of an image bearing member. The developing device 1*a*, which is an example of a developing means develops an electrostatic image by frictionally charging toner particles. It is capable of forming a test-patch, which is an example of a toner image for the image forming apparatus 10. A developer dispensing device 11*a*, which is an example of a means for replenishing the developing device 1 with toner, supplies the developing device 1*a* with toner by the amount equal to the amount by which toner was used for image formation.

An optical sensor 41, which is an example of a means for detecting the amount of the toner of which a test-patch on the recording medium conveyance belt 21 is made. More specifically, the test-patch (toner image) is formed on the photosensitive drum 3*a*, and is transferred onto the recording medium conveyance belt 21, which is another rotationally movably member. Then, the optical sensor 41 detects the amount of toner in the test-patch. The output of the optical sensor 41 is proportional to the amount (per unit area) by which toner was transferred onto the recording medium conveyance belt 21. The optical sensor 41 projects infrared light upon the recording medium conveyance belt 21, and detects the infrared light reflected by the recording medium conveyance belt 21. A permeability sensor 109, which is a means for detecting the toner ratio of the developer, is capable of detecting the toner ratio of the developer in the developing device 1*a*.

The developing means container 101 of the developing device 1*a* contains two-component developer, which is a mixture of nonmagnetic toner and magnetic carrier. The ratio between the carrier and toner in the developer is 93:7 in weight ratio. The carrier used by the developing device 1*a* in this embodiment is ordinary magnetic carrier, that is, magnetic carrier made of a ferric substance. As for the physical properties of the magnetic carrier, the magnetic carrier is 24 $Am^2$ in saturation magnetization in a magnetic field which is 240 kA/m, $1\times10^8$-$10^{10}$ Ω·cm in specific resistance in an electric field which is 3,000 V/cm, and 50 μm in weight average particle diameter. The toner is made of coloring agent and polyester resin. It is 7.2 μm in weight average particles diameter, and is negatively chargeable. It contains hydrophobic choroidal silica (external additive).

Incidentally, instead of the carrier used by the developing device 1*a* in this embodiment, resinous magnetic carrier made of a binder resin, a magnetic metallic oxide, and a nonmagnetic metallic oxide, by polymerization, may be used. Further, instead of the toner used by the developing device 1*a* in this embodiment, a toner made of styrene-acrylic resin may be used. The method for manufacturing developer does not need to be limited to the one used to manufacture the developer used by the developing device 1*a* in this embodiment.

The developing device 1*a* has a development chamber 116 and a stirring chamber 117 formed by partitioning the internal space of the developing means container 101 by a partitioning wall which extends from one lengthwise end of the container 101 to the other. The internal space of the development chamber 116 is in connection with the internal space of the stirring chamber 117 at their lengthwise ends, forming thereby a developer circulation path. Further, the developing device 1*a* has a developer application screw 106 and a developer stirring screw 107, which are in the development chamber 116 and stirring chamber 117, respectively. The developer application screw 106 and developer stirring screw 107 are opposite in the direction in which they convey the developer in their lengthwise direction. Thus, as the two screws 106 and 107 are rotated, the developer in the developing device 1*a* is circularly moved in the developing means container 101 in such a manner that the developer in the development chamber 116 is partially moved into the stirring chamber 117, and the developer in the stirring chamber 117 is partially moved into the development chamber 116.

As the developer in the developing means container 101 is stirred by the development screw 106 and stirring screw 107, the toner and carrier are frictionally charged. Consequently, the toner obtains a preset amount of charge.

The developing means container 101 of the developing device 1*a* is provided with an opening which faces the photosensitive drum 3*a*. The development sleeve 102 is rotatably supported in the development chamber 106 so that its peripheral surface faces the peripheral surface of the photosensitive drum 3*a* through the opening, and also, so that its peripheral surface is partially exposed from the container 101. The development sleeve 102 is formed of a nonmagnetic metallic substance. There is a stationary magnetic roller 103 in the internal space of the development sleeve 102. The magnetic roller 103 is positioned so that each of its magnetic poles generates a magnetic field of a preset strength, in a specific area of the adjacencies of the peripheral surface of the development sleeve 102, in terms of the rotational direction of the development sleeve 102.

The developing device 1*a* is provided with a regulation blade 105, which is positioned so that a preset amount of gap is maintained between the blade 105 and the peripheral surface of the development sleeve 102. The magnetic roller 103 is positioned so that its magnetic pole N1 corresponds in position to the regulating edge of the regulation blade 105. Thus, as the developer on the development sleeve 102 is moved through the gap between the regulating edge of the regulation blade 105, and the portion of the peripheral surface of the development sleeve 102, which corresponds in position to the magnetic pole N1, the toner particles are rubbed by the carrier particles and/or the peripheral surface of the development sleeve 102. Thus, the toner particles are increased in the amount of charge.

As the development sleeve 102 is rotated, the developer in the development chamber 116 is borne by the development sleeve 102, in the adjacencies of the magnetic pole N2. Then, as the developer on the peripheral surface of the development sleeve 102 is moved through the area which corresponds in position to the magnetic pole S2, it is formed into a thin layer of the developer by the regulation blade 105, and then, while the thin layer of the developer is conveyed through the area which corresponds in position to the magnetic pole S1, the thin layer of the developer is formed into a magnetic brush, that is, a brush whose microscopic magnetic bristles are roughly in the form of a fir tree, by the magnetic force from the pole S1. Thus, the magnetic brush formed of the developer rubs the peripheral surface of the photosensitive drum 3*a*, developing thereby the electrostatic image on the peripheral surface of the photosensitive drum 3*a*. To the development sleeve 102, an oscillatory voltage, which is a combination of a DC voltage Vdc and an AC voltage Vac, is applied by a high voltage power source 112 for development.

<Patch Detection ATR>

Referring to FIG. 2, in the patch detection ATR, a test-patch, which is an example of a toner image for adjusting the image forming apparatus 10 (developing device 1*a*) in the amount by which toner is charged, is detected by an optical sensor 41. Then, a developer dispensing device 11*a* is adjusted in response to the results of the detection so that the toner in the developing device 1*a* remains stable in the amount of charge. The patch detection ATR adjusts the developer dispensing device 11*a* based on the output of the permeability sensor 109 so that the toner ratio of the developer in the developing device 1*a* remains stable at a preset value. The patch detection ATR adjusts the developing device 1*a* in the ratio between the toner and carrier in the developing device 1*a* so that the amount of toner of which the patch is formed remains stable at a preset value.

A latent image formed on the peripheral surface of the photosensitive drum 3*a* is made up of the exposed points of the uniformly charge portion of the peripheral surface of the photosensitive drum 3*a*, and the unexposed points of the uniformly charge portion of the peripheral surface of the photosensitive drum 3*a*. The difference between the potential level VL of the exposed points and the potential level Vdc of the DC voltage is referred to as a development contrast Vcont. In order to develop an electrostatic image on the photosensitive drum 3*a*, toner is adhered to the exposed points of the uniformly charged portion of the peripheral surface of the photosensitive drum 3*a* by an amount which corresponds to the amount of the development contrast Vcont. As the toner is adhered to the peripheral surface of the photosensitive drum 3*a*, the electrostatic image on the photosensitive drum 3*a* is reversely developed into a toner image made up of a preset amount of toner. In an area 100 where the peripheral surface of the development sleeve 102 faces the peripheral surface of the photosensitive drum 3*a* with the presence of a microscopic distance between the two surfaces, the negatively charged toner particles in the magnetic brush on the development sleeve 102 escape from the positively charged carrier particles which have kept the toner particles electrostatically adhered thereto, and transfer onto the exposed points of the uniformly charged area of the peripheral surface of the photosensitive drum 3*a*, which are VL in potential level, being therefore more positive relative to the magnetic carriers.

The developer remaining on the downstream side of the peripheral surface of the development sleeve 102, relative to the development area in terms of the rotational direction of the development sleeve 102, is stripped away from the peripheral surface of the development sleeve 102 by the repulsive magnetic field generated by the combination of the magnetic poles N3 and N2, and falls back into the development chamber 116 (recovered into development chamber 116).

The aforementioned developer dispensing device 11*a* for replenishing the developing device 1*a* with toner is above the stirring chamber 117. It has a video-counter 65 for estimating the amount of the toner consumed by image formation, and replenishes the stirring chamber 117 of the developing device 1*a* with toner, by an amount equal to the amount of the toner consumption estimated by the video-counter, each time an image is completed.

The method for replenishing the stirring chamber 117 with toner is as follows. For example, the amount by which toner is consumed per image is estimated by cumulatively counting the number of pixels (dots) of each image to be exposed by the exposing device 6*a* whose laser light source is activated by binary exposure signals. Instead, it may be estimated by integrating, in terms of gradation, of each of microscopic areas (pixels) of the yellow monochromatic image obtained by separating an image to be formed, into multiple monochromatic images of the primary colors. Although the replenishment toner used by the developing device 1*a* in this embodiment was pure toner (100% toner), the method used to replenishing the developing device 1*a* in this embodiment with toner may be used in combination with a method which continuously replaces, by a small amount, the developer in the developing device with developer which is roughly 10% in carrier content.

An image density level at which an image is formed is immensely effected by the toner density (T/D ratio) of developer in terms of weight ratio. In a case where the amount by which the developing device la is replenished with toner using a toner delivery system based on the video-counting method is slightly smaller than the amount of the toner consumption, the developer in the developing device la gradually reduces in toner density (T/D ratio), with the increase in the cumulative number of images formed. With the decrease in the toner density, the frequency with which each toner particle is rubbed by carrier particles increases. Consequently, the toner particles increase in the average amount of electrostatic charge. Therefore, the amount by which toner adheres to an electrostatic image reduces, assuming the development contrast Vcont remains the same. In other words, the developing device 1*a* (image forming apparatus 10) reduces in the amount by which it adheres toner to an electrostatic image. That is, it reduces in image density.

On the contrary, if the amount by which the developing device 1*a* is replenished with toner per image is slightly greater than the amount of toner consumption per image, the developer in the developing device 1*a* gradually increases in toner density (T/D ratio) with the increase in the cumulative count of images formed. With the increases in the toner density, each toner particle in the developer in the developing device 1*a* reduces in the frequency with which it is rubbed by the carrier particles. Consequently, the toner particles in the developer reduce in the average amount of electrostatic charge. Therefore, the amount by which toner adheres to an electrostatic image increases, assuming the development contrast Vcont remains the same. In other words, the developing device 1*a* (image forming apparatus 10) increases in the amount by which it adheres toner to an electrostatic image. That is, it increases in image density.

Thus, the permeability sensor 109 is attached to the developing device container 101 to continuously detect the toner density (T/D ratio) of the developer in the developing device 1*a*, and the amount by which toner is delivered to the stirring chamber 117 using the toner delivery system based on the video-counting method is adjusted in response to the output of the permeability sensor 109 so that the developer in the developing device 1*a* remains stable in the toner density. The means for detecting the toner density in the developing device 1*a* does not need to be limited to the permeability sensor 109, which is an inductor. That is, a means for detecting the hue of the light reflected by the developer in the developing device 1*a* while the developer is circulated through the developing device 1*a*, may be employed in place of an inductor.

In either case, if the toner density detected by the toner density sensor (permeability sensor 109) falls below a target range for the toner density, the developing device 1*a* is increased in the amount by which it is replenished with toner by the toner delivery system based on the video-counting, whereas if the toner density increases beyond the target range, the developing device 1*a* is reduced in the amount by which it is replenished with toner by the toner delivery system.

However, even if the developing device 1*a* is controlled so that the toner density (T/D ratio) detected by the permeability sensor 106 remains stable at a preset level, the image density at which the developing device 1*a* (image forming apparatus 10) outputs images is affected by the developer deterioration and changes in ambience.

Thus, the image forming apparatus 10 in accordance with the present invention is designed to perform the patch detection ATR control (Automatic Toner Replenishment Sequence) to adjust its developing device 1*a* in the target value for the toner density (T/D ratio) so that the developing device 1*a* remains stable in the amount of toner charge. More specifically, the image forming apparatus 10 interrupts, with preset intervals, the image forming operation it is performing, and detects, with the use of an optical sensor 41, the amount of the toner in a test-patch (toner image) formed under a preset condition. Then, if the amount of the toner in the test-patch is below a permissible range, the image forming apparatus 10 inflates the amount set, based on the video-count, as the amount by which toner is to be delivered to the stirring chamber 117, increasing thereby the toner density (T/D ratio) of the developer in the developing device 1*a*. On the contrary, if the amount of the toner in the test-patch is above a permissible range, the image forming apparatus 10 deflates the amount set, based on the video-count, as the amount by which toner is to be delivered to the stirring chamber 117, decreasing thereby the toner density (T/D ratio) of the developer in the developing device 1*a*.

In the patch detection ATR, a test-patch, which is a toner image for controlling the toner in the developing device 1*a* in the amount of electrostatic charge, is formed on the photosensitive drum 3*a*, and is transferred onto the recording medium conveyance belt 21, which is an example of a rotational member. The transferred patch on the recording medium conveyance belt 21 is measured in the amount of toner by the optical sensor 41. Then, the target value for the toner density (T/D ratio) is adjusted based on the detected amount of the toner in the test-patch, to stabilize the image forming apparatus 10 (developing device 1*a*) in image density.

The normal amount by which the developing device 1*a* is to be replenished with toner is calculated based on the image ratio of the image to be formed, which is obtained by the method based on video-counting. Then, the normal amount is adjusted based on the amount of the toner in the test-patch, which is detected by the patch detection ATR system. If the amount by which the developing device 1*a* is replenished with toner is suddenly changed by the patch detection ATR system, the image forming apparatus 10 (developing device 1*a*) is affected in continuity in terms of image density. Therefore, the amount by which adjustment is made by the patch detection ATR control per adjustment is limited. Therefore, the developing device 1*a* is kept proper in the toner density (T/D ratio), whereby the image forming apparatus 10 is prevented from fluctuating in image density and/or outputting images of low quality.

<Formation, Transfer, and Measurement of Patch>

Figure 3:
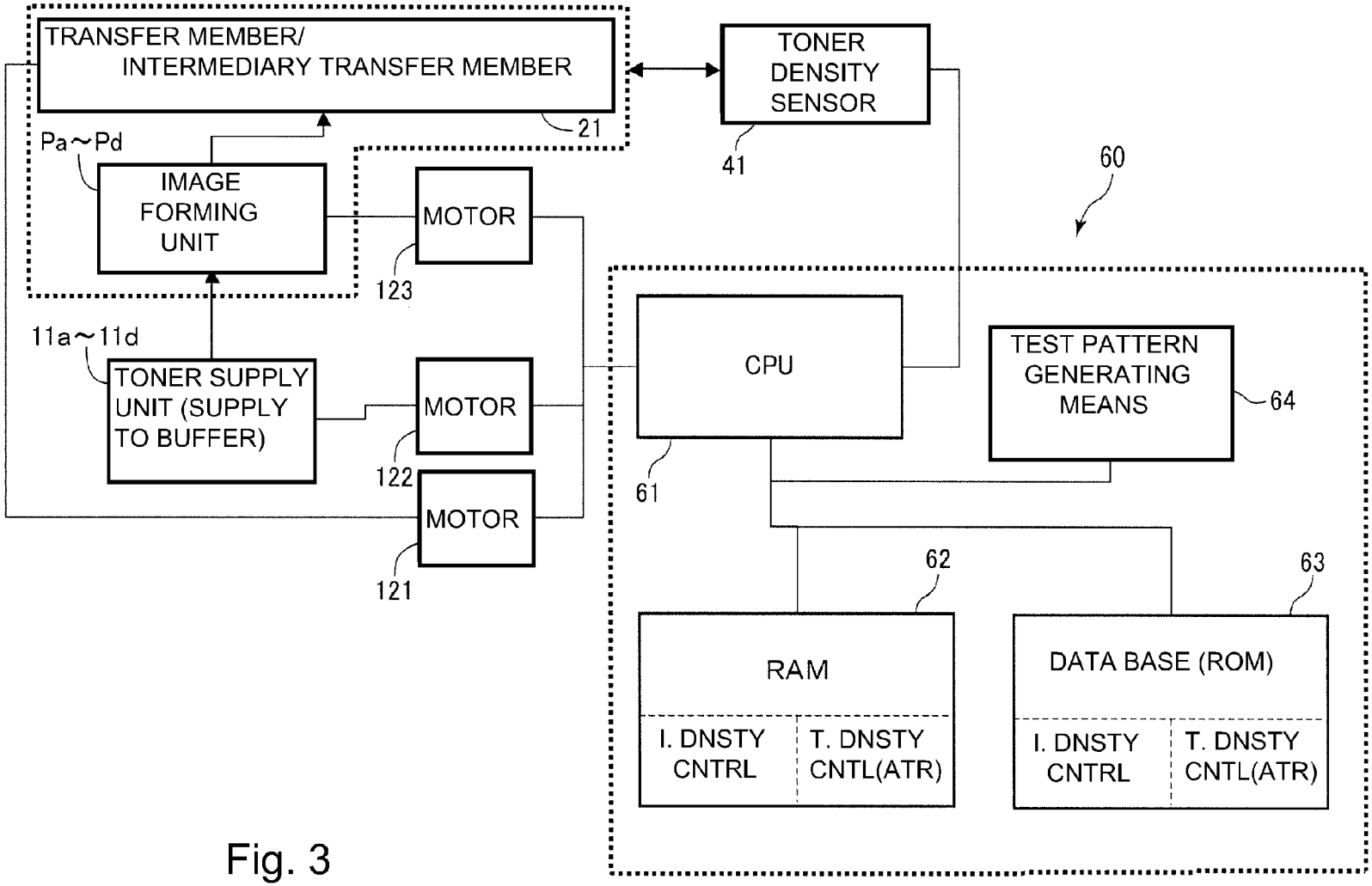
FIG. 3 is a block diagram of the control system of the image forming apparatus in the first embodiment, which uses a test-patch (toner image) to control the apparatus.
Figure 4:
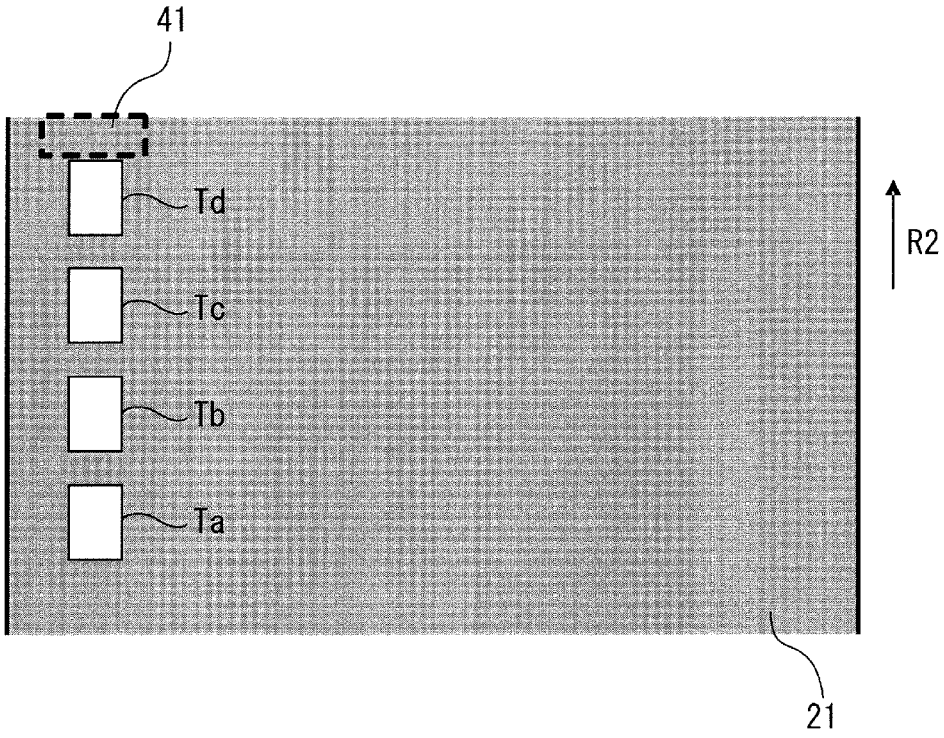
FIG. 4 is an example of the test-patch after the transfer of the test-patch onto the recording medium conveyance belt.

FIG. 3 is a block diagram of the test-patch-based system for controlling the developing device 1*a* in the toner replenishment amount. FIG. 4 is a drawing of the test-patches after the transfer of the test-patches onto the recording medium conveyance belt 21.

Referring to FIG. 1, the optical sensor 41 is on the downstream side of the image forming station Pd in terms of the moving direction of the recording medium conveyance belt 21. It is in the adjacencies of the belt 21, and faces the recording medium bearing surface of the belt 21. The optical sensor 41 projects a beam of infrared light with the use of an LED, toward the recording medium conveyance belt 21 at such an angle that the beam hits the surface of the belt 21 at an angle of 45°, and detects the amount of the light reflected by the belt 21, with the use of a photo-diode. Then, it outputs a signal, which reflects the reflectance of the surface of the belt 21, to the control section 60 of the image forming apparatus 10. As the control section 60 receives the output signal of the optical sensor 41, it calculates the amount of the toner in the test-patch on the belt 21.

Then, the control section 60 forms a test-patch (formed of toner) on the photosensitive drums 3*a*, 3*b*, 3*c*, and 3*d* by controlling the image forming stations Pa, Pb, Pc, and Pd, and transfers the test-patches onto the recording medium conveyance belt 21 as shown in FIG. 4. Then, as the recording medium conveyance belt 21 is rotated, the yellow, magenta, cyan, and black patches Ta, Tb, Tc, and Td on the recording medium conveyance belt 21 are sequentially measured in the amount of reflectance. Then, the amount of the toner in each patch is calculated by the control section 60 from the measured amount of reflection of each patch. After the test-patches Ta, Tb, Tc, and Td are measured in the amount of reflectance, they are scraped away by the belt cleaning device 22 (toner of which patches are formed is recovered by cleaning device 22).

Next, referring to FIG. 3, the CPU 61 of the control section 60 is in connection to a RAM 62, a ROM 63, and a test pattern generating portion 64. The RAM 62 is used for the patch detection ATR operation, and the ROM 63 is where the programs to be carried out by the CPU 61, various data used for control or the like are stored. It has a writable area in which various initial settings can be written to be retained. The test pattern generating portion 64 generates a test-patch pattern. Incidentally, in some image forming apparatus, the test pattern generating portion 64 is installed in the video controller of the control section 60.

The control section 60 forms an electrostatic image of a test-patch on the photosensitive drums 3*a*, 3*b*, 34*c*, and 3*d*, by controlling the exposing apparatus 6*a* based on the test-patch data generated by the test pattern generating section 64, so that the development contrast Vcont will have a preset value. Then, the four electrostatic images are developed into patches Ta, Tb, Tc, and Td, by the developing devices 1*a*, 1*b*, 1*c*, and 1*d*, respectively.

The test-patches Ta, Tb, Tc, and Td have a preset mesh pattern, and have halftone gradation. The test-patch design is such that the screen pattern and halftone gradation correspond in position to where the optical sensor 41 is highest in sensitivity, that is, where the output of the optical sensor 41 is highest in sensitivity in terms of density differentiation.

The optical sensor 41 transmits to the CPU 61, the 10 bit signals (0-1,024) which reflect the measured amount of the toner in each patch. The CPU 61 calculates the value for the parameters for controlling the amount by which the developing device 1*a* is to be replenished with toner, based on the output signals from the optical sensor 41.

It is when the output value of the optical sensor 41 is in a range of 200-1,000 that the optical sensor 41 is excellent in sensitivity. Therefore, the gradation density of the test-patch (referential image) is set so that the value of the output of the optical sensor 41 falls in a range of 400-800.

There are the following two methods for controlling the amount by which the developing device is replenished with toner, by measuring the amount of the toner in the test-patch on the recording medium conveyance belt 21.

(1) Patch detection ATR which adjusts the developing device 1*a* in the amount of toner charge, by adjusting the amount by which the developing devices 1*a*, 1*b*, 1*c*, and 1*d* are replenished with toner.

(2) Image Density Adjustment Control which adjusts such a parameter as the intensity of the exposure beam of light, to adjust the developing device 1*a* in the gradation density at which each developing device develops an electrostatic image.

In both controlling methods, the optical sensor 41 is used for both the patch detection ATR and development contrast adjustment. However, test-patches are varied in specification to optimize the control in performance. Further, the two controlling methods are roughly the same in the operational sequence from the formation of a test-patch in the image forming stations Pa, Pb, Pc, and Pd, to the measurement of the amount of the toner in each patch on the recording medium conveyance belt 21. However, the two are completely different in the objective and what is affected by the control.

The image density adjustment control in the low speed mode, which is an example of the first controlling means, the condition under which an electrostatic image is formed in the low speed mode, or the first image formation speed. In the image density adjustment control in the low speed mode, a test-patch is formed at a low process speed (in low speed mode), and is transferred onto the recording medium conveyance belt 21. Then, the test-patch on the recording medium conveyance belt 21 is measured in the amount of toner by the optical sensor 41. Then, the electrostatic image formation condition for the low speed mode is set based on the results of the measurement.

In the image density adjustment control for the normal mode, which is an example of the second controlling means, the electrostatic image formation condition for the normal mode is set in the image formation speed for the normal mode, which is an example of the image formation speed. In the image density adjustment control in the normal mode, a test-patch is formed in the normal process speed, and is transferred onto the recording medium conveyance belt 21. Then, the test-patch on the recording medium conveyance belt 21 is measured in the amount of toner by the optical sensor 41. Then, the electrostatic image formation condition for the normal mode is set based on the result of the measurement.

<Image Density Adjustment Control>

In order to keep the image forming apparatus 10 at a high level in terms of image quality, and also, stable in image density at a preset level, regardless of the differences among apparatuses, changes in ambience, and/or the like factors, the control section 60 makes the image forming apparatus 10 periodically carry out the image density adjustment sequence to adjust the condition under which an electrostatic image is formed. In the sequence, a test-patch, which is an example of a toner image for the image density adjustment, is formed, and the image forming apparatus 10 is adjusted in the intensity of the beam of exposure light for forming an electrostatic image, amount of development voltage, etc., to be optimized in image density.

In the image density adjustment control, multiple patches which are different in tone (including halftone) are formed for each color, and multiple image density levels including the maximum and halftone gradations are set for each color, based on the amount of the toner in each patch, which are detected by the optical sensor 41. The image density is used for correcting the image forming apparatus 10 (developing device 1*a*) in the reflection density of the fixed image on a sheet of recording medium. Therefore, a test-patch for image density adjustment has to be formed, transferred, and measured in the amount of toner in the same image formation speed as each image formation mode.

As for the frequency with which the image density adjustment sequence is to be carried out, it is desired to be lower by one order of magnitude than the frequency with which the patch detection ATR control is carried out. Further, it is desired that the condition under which each electrostatic images is to be formed is adjusted on condition that it is assured by the patch detection ATR control that the developing device 1*a* is kept stable in the amount of toner charge at a preset level. The control section 60 cumulatively counts the number of the images formed per image formation mode, and adjusts the image forming apparatus 10 (developing device 1*a*) in image density as the image count reaches 1,000. However, the image forming apparatus 10 (developing device 1*a*) may be adjusted in image density as the sum of the cumulative count of the images formed in both image formation modes reaches a preset value.

If the timing with which the patch detection ATR control is to be performed comes up during an image forming operation in which a substantial number of images are to be continuously formed, the operation has to be interrupted to perform the patch detection ATR control. Such interruption reduces the image forming apparatus 10 in productivity. In particular, in the case where the image forming apparatus 10 is operated in the low speed mode to continuously form a substantial number of images, the image forming apparatus 10 is already lower in productivity because it is in the low speed mode. Thus, the patch detection ATR control is carried out while the image forming apparatus 10 is operated in the low speed mode, and therefore, the image forming apparatus 10 is further reduced in productivity.

In a case where an image forming operation in the low speed mode is frequently interrupted by the patch detection ATR control, and the patch detection ATR control is carried out while the image forming apparatus 10 is kept in the low speed mode, the long downtime frequently occurs.

While the image forming apparatus 10 is controlled to form a test-patch, it cannot be used for the normal image forming operation. In other words, the test-patch formation reduces the image forming apparatus 10 in productivity. In particular, in the case where the image forming apparatus 10 is controlled to form a test-patch while it is operated in the low speed mode, the image forming apparatus 10 reduces in productivity even more, because it takes a substantial length of time to form a test-patch and convey it.

As for the solution to this problem, Japanese Laid-open Patent Application 2007-148134 proposes that as an image forming operation in the low speed mode is interrupted for the image density adjustment, the image forming apparatus (10) is to be switched in operational mode from the low speed mode to the normal mode in order to minimize the downtime attributable to the image density adjustment, and then, the image density adjustment sequence is to be carried out.

This method, however, suffers from the following problem. That is, the measured amount (per unit area) of the toner in a test-patch formed and transferred in the normal mode (different in operation speed from low speed mode) cannot be used to correctly set the condition for forming an electrostatic image in the low speed mode. That is, a test-patch formed in the low speed mode is smaller in the image density error attributable to its formation and transfer, and the measurement of the amount of the toner therein, than a test-patch formed in the normal mode.

In comparison, in the patch detection ATR control, even if the image forming apparatus 10 is changed in operational speed to form and transfer a test-patch, and measure the amount of the toner in the test-patch, the errors in the formation and transfer of the test-patch, and the measurement of the amount of the toner in the test-patch, which are attributable to the change in the operational speed of the image forming apparatus 10, can be eliminated (canceled), as long as the speed to which the operational speed of the image forming apparatus 10 is switched is equal to the speed to which the operational speed of the image forming apparatus 10 is set during the initial setting of the condition for the patch detection ATR control. That is, changing the image forming apparatus 10 in operation speed for the patch detection ATR control does not affect the accuracy in the amount by which toner is delivered by the toner dispensing device 11*a*. That is, it does not affect the accuracy in the amount of toner charge.

Thus, in the following preferred embodiments of the present inventions, the image forming apparatus 10 is minimized in the amount of the productivity reduction attributable to the patch detection ATR control, using the following method. That is, as an image forming operation which is being carried out in the low speed mode by the image forming apparatus 10 is interrupted for the patch detection ATR control, the image forming apparatus 10 is switched in operation mode from the low speed mode to the high speed mode (or normal mode) to quickly finish the patch detection ATR control. Then, as soon as the patch detection ATR control is completed, the image forming apparatus 10 is switched in operational mode back into the low speed mode, that is, the mode in which it was operated before it was interrupted for the patch detection ATR control, to restart the interrupted image forming operation in the low speed mode.

With the employment of the above described practice, an image forming apparatus capable of operating at various speeds can be kept as small as possible in the length of downtime attributable to the patch detection ATR control, while keeping the image forming apparatus stable in image density.

<Embodiment 1>

Figure 5:
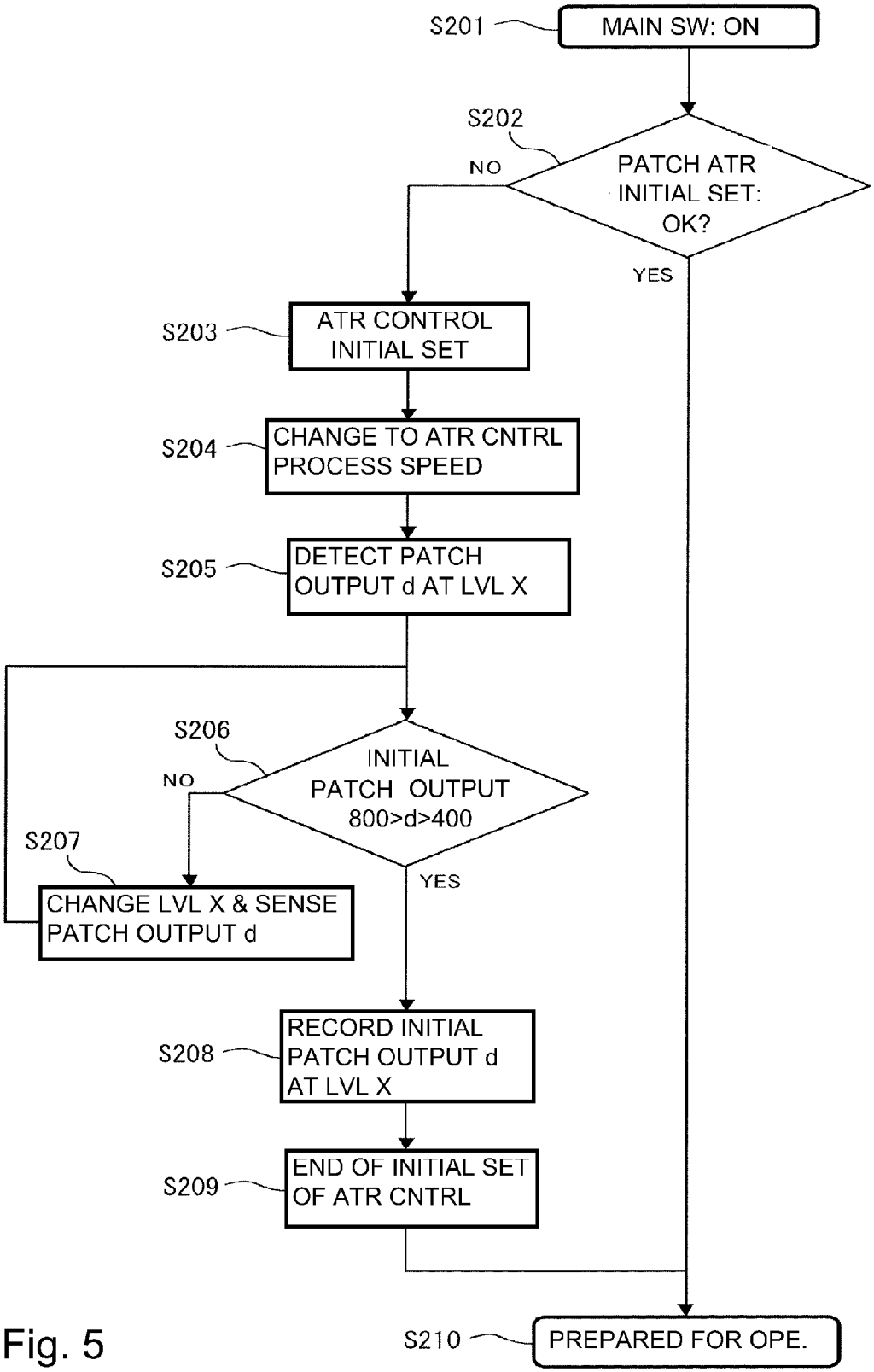
FIG. 5 is a flowchart of the control sequence for initializing the image forming apparatus for the patch detection ATR control (automatic toner replenishment), in the first preferred embodiment of the present invention.
Figure 6:
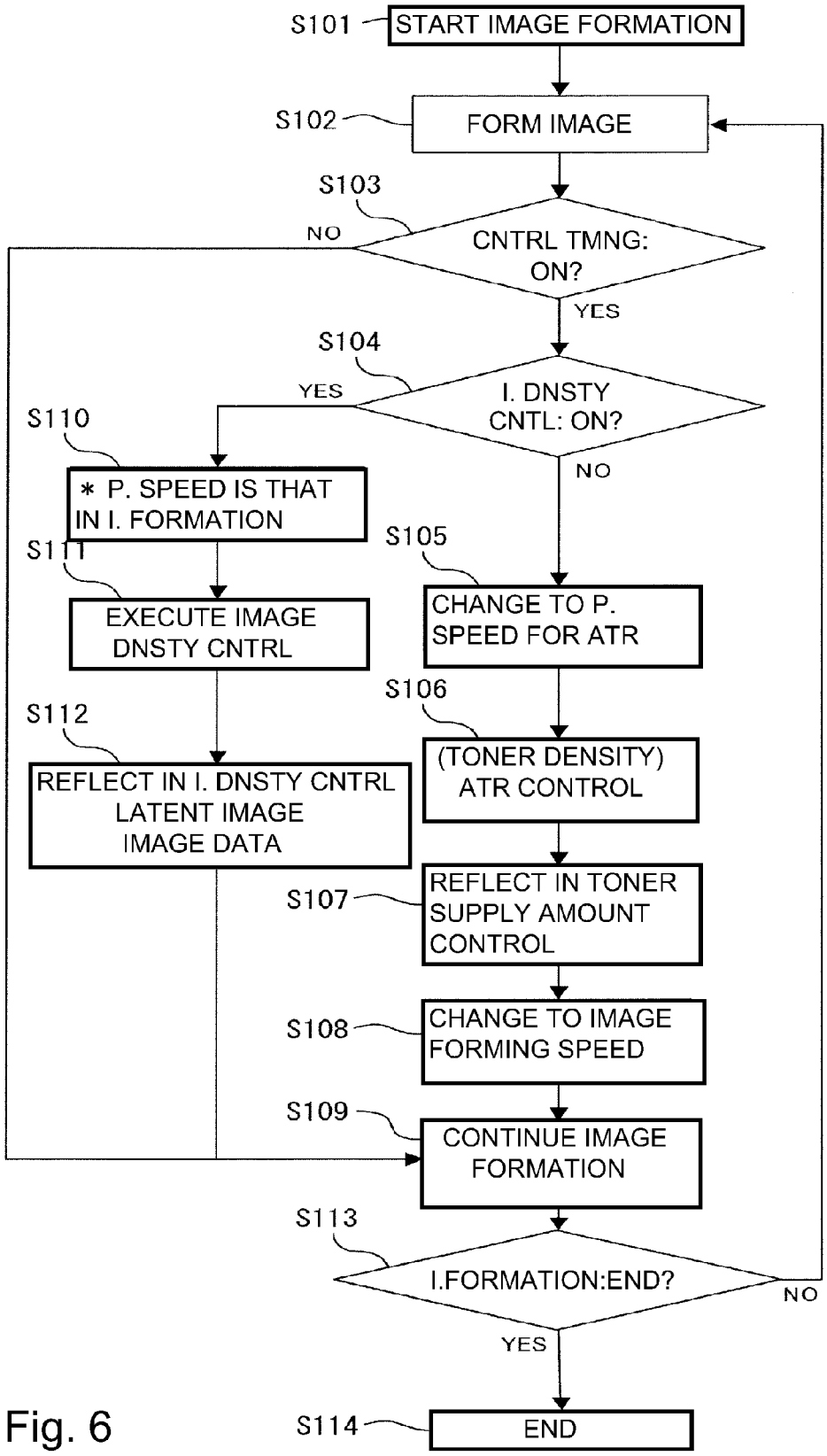
FIG. 6 is a flowchart of the patch detection ATR control (automatic toner replenishment) sequence in the first preferred embodiment, which is carried out by interrupting an ongoing image forming operation.

FIG. 5 is a flowchart of the operational sequence for initializing the image forming apparatus 10 for the patch detection ATR control, in the first preferred embodiment of the present invention. FIG. 6 is a flowchart of the patch detection ATR control sequence to be carried out by interrupting a normal image forming operation.

Referring to FIG. 1, the image forming station Pa, which is an example of an image forming means, is provided with the developing device 1*a*, which is an example of a developing means. It forms an image on a sheet of recording medium. The developing device 1*a* develops the electrostatic image formed on the photosensitive drum 3*a*, which is an example of an image bearing member, with the use of toner and carrier.

The optical sensor 41, which is an example of a detecting means, detects the amount of the toner in the toner image transferred onto the recording medium conveyance belt 21 after being formed on the photosensitive drum 3*a*.

The control section 60 which is an example of an adjusting means adjusts the image formation condition for the image forming station Pa, based on the results of the detection of the amount of the toner in the toner image (test-patch), which is a toner image for the first control.

The developer dispensing device 11*a* which is a developer dispensing means replenishes the developing device 1*a* with developer, based on the result of detection, by the optical sensor 41, of the amount of the toner in the test-patch which is a toner image for the second control.

When the image forming apparatus 10 is in the normal mode which is the first image formation mode in which it can operate, it forms images at the first image formation speed. When the image forming apparatus 10 is in the low speed mode which is the second image formation mode in which it can operate, it forms images at the second image formation speed, which is slower than the first image formation speed.

When the image forming apparatus 10 forms a test-patch (toner image) for the first control while it is in either the normal mode or slow speed mode, the control section 60 makes the image forming apparatus 10 form the test-patch in the same speed as the speed at which the image forming apparatus 10 is operated. When the image forming apparatus 10 forms a test-patch (toner image) for the second control, the control section 60 makes the image forming apparatus 10 form the test-patch in the third image formation speed, which is higher than at least the second image formation speed.

In the first preferred embodiment, the third image formation speed is the highest image formation speed among the multiple image formation speeds in which the image forming apparatus 10 is capable of forming an image on recording medium.

When the image forming apparatus 10, which is brand-new, is used for image formation for the first time, or when it is used for the first time after the replacement of its photosensitive drum or drums, developing device or devices, and/or process cartridges, the control section 60 makes the image forming apparatus 10 carry out the initialization sequence for the patch detection ATR control shown in FIG. 5. In the initialization sequence for the patch detection ATR control, a test-patch (toner image) is formed by carrying out the charging, exposing, and developing processes under a preset condition, and the test-patch density is obtained by measuring the amount (per unit area) of the toner in the test-patch formed by the image forming apparatus 10 in the above described brand-new condition. Then, the obtained patch density is recorded as the referential patch density. Then, the value obtained by measuring the amount of the reflectance of the test-patch having the referential density is used as the referential reflectance value. Then, this referential reflectance value is recorded as the target referential reflectance value.

In the patch detection ATR control sequence carried out after the completion of the initialization sequence for the patch detection ATR control, a test-patch (toner image) is formed under the same condition as the condition under which a test-patch (toner image) was formed in the initialization sequence for the patch detection ATR control, and the reflectance of the test-patch is detected by the optical sensor 41. Then, the detected value of the reflectance of the test-patch is compared with the target value. Then, the control section 60 controls the developer dispensing device 11*a* so that the amount of the electrostatic charge of the toner in the developing device 1*a* is restored to the same value as the value at which the initialization sequence for the patch detection ATR control was carried out. That is, the control section 60 controls the developer dispensing device 11*a* so that the amount by which toner is adhered to the peripheral surface of the photosensitive drum 3*a* becomes the same as the amount by which toner was adhered to the peripheral surface of the photosensitive drum 3*a* in the initialization sequence for the patch detection ATR control.

When the target value is used in the above described manner, the speed in which a test-patch is formed in the initialization sequence for the test-patch-based ATR does not need to be the same as the image formation mode for an actual image forming operation, for the following reason. That is, in the patch detection ATR control, the amount by which the developing device 1*a* is replenished with toner is adjusted based on the amount of difference between the detected amount of reflectance and the target value. That is, it is desired that a test-patch (toner image) is formed under the same condition (image formation speed, etc.) under which a test-patch was formed to set the referential value, that is, the target value.

Referring to FIG. 5 as well as FIG. 3, before the patch detection ATR control is started, the initialization sequence for the test-patch-based ATT has to be carried out. As the electric power source of the image forming apparatus 10 is turned on (S201), the control section 60 determines whether or not the initialization data for the patch detection ATR control are in the RAM 62 (S202).

When the initialization data for the patch detection ATR control are in the RAM 62, the control section 60 prepares the image forming apparatus 10 for image formation (S210). When the data are not in the RAM 62, the control section 60 initializes the image forming apparatus 10 for the patch detection ATR control (S203).

The control section 60 switches the image formation speed of the image forming apparatus 10 to the image formation speed for the patch detection ATR control (S204), forms a test-patch (toner image) with the exposure level set to the test-patch formation level X, transfers the test-patch onto the recording medium conveyance belt 21, and detects the amount of the toner in the test-patch by the optical sensor 41 (S205). In the first embodiment, the image formation speed for the initialization for the patch detection ATR control is set to the same speed as the process speed for the normal mode.

When the output value d of the optical sensor 41 is within a range of 400-800, the control section 60 records the test-patch formation exposure level X and value d in the RAM 62 (S208). However, if the output value d is outside the preset range, the control section 60 changes the test-patch formation exposure level. Then, it forms a test-patch for the second time, transfers the test-patch onto the recording medium conveyance belt 21, and detects the amount of the toner in the test-patch on the recording medium conveyance belt 21 (S207), obtaining thereby the output value d for the second patch (S206).

As for the changing of the test-patch formation exposure level, the exposing device 6*a* is changed in the halftone gradation so that the output value of the optical sensor 41 will fall in the preset range. That is, the test-patch formation exposure level is repeatedly changed until the output value d falls in the preset range.

As the test-patch formation exposure level X and output value d are obtained (Yes in S206), the control section 60 ends the initialization sequence for the patch detection ATR control. Then, the control section 60 switches the image formation speed to the process speed for the pending image forming operation (S210), and prepares the image forming apparatus 10 for the image formation (S210).

In the patch detection ATR control which comes thereafter, the control section 60 makes the image forming apparatus 10 form a test-patch at the test-patch formation exposure level X stored in the RAM 62 in the initialization sequence for the patch detection ATR control, and uses the output value d as the referential output value (=target value). This is the control carried out by the control section 60 for the initialization sequence for the patch detection ATR control, which involves the optical sensor 41.

Next, referring to FIG. 6 along with FIG. 3, the actual patch detection ATR control is carried out by interrupting the ongoing image forming operation to adjust the toner replenishment amount so that the amount (per unit area) of the toner in the test-patch converges to a preset value. As an image formation signal comes to the image forming apparatus 10 when the image forming apparatus is ready for image formation, the control section 60 starts an image forming operation (S101), and forms one image (S102), and at roughly the same time, it determines whether or not it is the time for the patch detection ATR control, by referring to the RAM 62 and ROM 63 (S103). It is in the RAM 62 and ROM 63 that the data base for determining the timing for the patch detection ATR control. As an image formation signal arrives, the control section 60 looks up the cumulative number of images formed since the immediately preceding control, and determines how many prints have to be formed before the control timing arrives (S103).

The patch detection ATR control needs to be carried out with a preset interval beyond which the image forming apparatus 10 is likely to deviate in image density and tone density. The frequency with which the patch detection ATR control is to be carried out is desired to be set according to how toner is used and the image ratio. In the first embodiment, regardless of whether the image forming apparatus 10 is in the normal mode or low speed mode, the patch detection ATR control is carried out with such an interval (frequency) that is equivalent to 200 prints of size A4, which is 5% in image ratio, formed by conveying the sheets of recording medium in such an attitude that the long edges of which are parallel to the recording medium conveyance direction. The results of the patch detection ATR control are used to control the developer dispensing amount of the developer dispensing device 11*a*, until the next patch detection ATR control.

If the control section 60 determines that it is not the time for the control (No in S103), it continues the ongoing image forming operation (S109). If it determines that it is the time for the control (Yes in S103), it determines whether the control to be carried out is the patch detection ATR control or image density adjustment (S104).

If the control section 60 determines that the control to be carried out is the image density adjustment (Yes in S104), it does not change the image forming apparatus 10 in image formation speed (S110), makes the image forming apparatus 10 form a test-patch, and carries out the image density adjustment sequence (S111). The objective of the image density adjustment sequence is to optimize the image forming apparatus 10 in terms of the density gradation of the test-patch on the sheet P of recording medium. Thus, if the image density adjustment sequence is carried out in a process speed different from the process speed of the ongoing image forming operation, the image forming apparatus 10 cannot be optimized in the image density. For example, in a case where an image forming operation for continuously forming a substantial number of images in the low speed mode is interrupted to carry out the image density adjustment sequence, the image density adjustment sequence is carried out in the process speed for the low speed mode.

The results of the image density adjustment sequence are reflected upon the image gradation data in the RAM 62 and ROM 63, and the value of the high voltage for latent image formation (S112). If the interrupted image forming operation is to be continued (No in S113), the interrupted image forming operation is restarted (S102). If it is not to be continued (Yes in S113), it is ended (S114).

On the other hand, if the control timing is for the patch detection ATR control (No in S104), the control section 60 changes the image formation speed to the process speed for the patch detection ATR control (S105). In the first embodiment, the process speed for the patch detection ATR control is the same as the process speed for the normal mode. In other words, the control section 60 changes the image formation speed to the process speed for the normal mode, and makes the image forming apparatus 10 carry out the patch detection ATR control (S106) to cause the amount of the toner change to converge to the value to which the amount was set in the initialization sequence for the patch detection ATR control.

For example, if the image forming apparatus 10 is in the low speed mode when it became the time for the patch detection ATR control, the control section 60 very quickly increases the image forming apparatus 10 in process speed to the process speed for the normal mode to prepare for the patch detection ATR control. On the other hand, if the image forming apparatus 10 is in the normal mode when it became the time for the patch detection ATR control, the control section 60 makes the image forming apparatus 10 carry out the patch detection ATR control while keeping the image forming apparatus 10 in the process speed for the normal mode.

As described above, in the patch detection ATR control, the amount of the toner in the test-patch is detected by the optical sensor 41 after the transfer of the test-patch onto the recording medium conveyance belt 21. Then, the control section 60 compares the detected amount of the toner in the test-patch with the target value set during the initialization sequence for the patch detection ATR control, and reflects the result of the comparison upon the developer replenishment amount (S107). More concretely, the relationship between the amount of the toner in a test-patch and the density of the test-patch has been stored in the ROM 63. Further, the relationship between the image density and toner density (T/D ratio) also has been stored in the ROM 63. Thus, the control section 60 calculates how much the developer replenishment amount is to be adjusted, based on the difference between the amount of the toner in the test-patch and the target value, with the reference to these data in the ROM 63.

In the first embodiment, if the control section 60 determines through the patch detection ATR control that the developing device 1*a* is low in toner density, it increases the toner replenishment amount by 5% based on the toner replenishment amount obtained by video-counting. Then, if the result of the next patch detection ATR control shows that the toner density is proper, the control section 60 continues to replenish the developing device 1*a* toner by the amount which is 5% greater than the toner amount obtained by the video counting, whereas if the result of the next patch detection ATR control shows that the toner density was higher than the proper one, the control section 60 cancels the 5% increase.

After the adjustment of the toner replenishment amount by the patch detection ATR control, the control section 60 changes the process speed of the image forming apparatus 10 back into the process speed for the interrupted image forming operation, in order to restart the interrupted image forming operation (S108). Then, it makes the image forming apparatus 10 continue the image forming operation (S109).

Each time an image is completed (S109), the control section 60 determines whether or not the completed image is the last image to be made in the ongoing image forming operation (S113). If the control section 60 determines that the image is the last one (Yes in S113), it ends the image forming operation (S114). If it determines that the image is not the last one (No in S113), it makes the image forming apparatus 10 form the next image (S102). This is how the control of the image forming apparatus 10 by the control section 60 flows.

The inventors of the present invention carried out the following experiment to confirm the effect of the first embodiment in terms of the downtime reduction. That is, in one of the two continuous image forming operation in the slow speed mode, the patch detection ATR control was carried out while keeping the image forming apparatus 10 in the process speed for the low speed mode, whereas in the other one, the image forming apparatus 10 was switched in process speed to the process speed for the normal mode, before the patch detection ATR control was carried out. Then, the two image forming operations were compared in terms of the cumulative length of downtime.

TABLE 1

| | Toner density control time | |
|---|---|---|
| | Low speed mode | Normal mode |
| Prior art | 28 sec | 1.5 sec |
| Embodiment 1 | 1.5 sec | 1.5 sec |
| Embodiment 2 | 1.0 sec | 1.0 sec |

As is evident from Table 1, the continuous image forming operation in which the image forming apparatus 10 was changed in the process speed to the process speed for the normal mode before the patch detection ATR control was carried out was 1.5 seconds in downtime, whereas the continuous image forming operation in which the patch detection ATR control was carried out without changing the image forming apparatus 10 in process speed was 2.8 seconds in downtime. This reduction in downtime is equivalent to the value obtained by dividing the sum of the total length (300 mm) of four patches aligned as shown in FIG. 4 and the circumference (100 mm) of the photosensitive drum 1, by the process speed.

The experiment confirmed that the patch detection ATR control kept the image forming apparatus 10 proper in image density. That is, the first embodiment of the present invention prevented the image forming apparatus 10 from changing in image density. That is, it enabled the image forming apparatus 10 to form excellent images throughout the continuous image forming operation.

In the first embodiment, the patch detection ATR control was carried out during the intervals between the formation of an image and the formation of the next image. However, the timing with the patch detection ATR control is to be performed does not need to be limited to the intervals between the consecutive two images. For example, instead of extending one of the recording sheet intervals and forming a test-patch during the extended recording sheet interval, a test-patch may be formed during the post-image formation sequence or pre-image formation sequence. Further, the patch detection ATR control may be carried out as soon as an image forming apparatus is turned on for the first time for a given day, during the pre-rotation immediately after the reception of the image formation job start signal, or immediately after the completion of each job. In any case, the length of time required to carrying out the patch detection ATR control can be significantly reduced by changing the processing speed of the image forming apparatus 10 to the process speed for the patch detection ATR control before starting the patch detection ATR control sequence.

Further, it is desired that the patch detection ATR control is carried out in consideration of the state (condition) of the image forming apparatus 10, while minimizing the image forming apparatus in the overall length of the downtime. For example, it is assumed here that the frequency with which an image forming operation is to be interrupted by the patch detection ATR control is equivalent to every 200th sheet of recording medium; the frequency with which an image forming operation is interrupted by the image density adjustment control is equivalent to every 100th sheet of recording medium; the image forming apparatus 10 has formed 198 prints, which is 5% in image ratio, since it carried out the immediately preceding patch detection ATR control, and 96 prints since it carried out the immediately preceding image density adjustment control; and an image formation signal has come in, which instructs the image forming apparatus 10 to output 100 prints which is 5% in image ratio.

According to the unmodified version of the patch detection ATR control, it becomes the time for the patch detection ATR control as the second prints is completed since the starting of the job for making the 100 prints. That is, the job is interrupted for the formation of a test-patch for the patch detection ATR control (downtime). Then, as the image forming operation is restarted, it becomes the time for the image density adjustment control after only two prints are outputted. Thus, the operation is interrupted by the downtime for forming a test-patch for the image density adjustment as it was interrupted by the downtime for forming the test-patch for the patch detection ATR control. In other words, the downtime is repeated with a very short interval. Therefore, the reduction in availability factor seems to be greater than it is actually.

One of the solutions to this problem is to delay the timing for the patch detection ATR control until 100th print of the ongoing image forming operation is completed. This solution, however, possibly changes the image forming apparatus 10 in image density. Thus, in order to ensure that the image forming apparatus 10 remains stable in image density at a proper level, the ongoing image forming operation has to interrupted at some point to carry out the patch detection ATR control. This is true also with the image density adjustment control. That is, the timing for the image density adjustment control cannot also be delayed until the 100th print of the ongoing image forming operation is completed.

In the above described case, therefore, in order to finish the job for printing the 100 images without the interruption by the downtime, both the patch detection ATR control and image density adjustment control are carried out before the job is started, or only the patch detection ATR control is carried out before the starting of the job, and the image density adjustment control is carried out after roughly 10 prints are outputted since the starting of the job.

Further, in the first embodiment, the amount of the toner in a test-patch detected in the actual patch detection ATR control is compared with the target value obtained through the initialization sequence for the patch detection ATR control. Therefore, a test-patch for the patch detection ATR control is formed without being affected by the image density adjustment control. Therefore, the developing device 1*a* is adjusted in the amount of toner charge without being affected by the image density adjustment control. Further, the image density adjustment control is carried out after the developing device 1*a* is precisely adjusted in the amount of toner charge by the patch detection ATR control. Therefore, this embodiment is higher than any image density adjustment control in accordance with the prior art, in terms of the accuracy with which the condition for forming an electrostatic image is set.

Therefore, it is desired that the frequency with which the image density adjustment control sets the condition for the formation of an electrostatic image while the image forming apparatus 10 is continuously forming a substantial number of images in the slow speed mode is lower than the frequency with which the patch detection ATR control adjusts the developer dispensing apparatus 11*a* during the same image forming operation, and also, that the frequency with which the image density adjustment control sets the condition for the formation of an electrostatic image while the image forming apparatus 10 is continuously forming a substantial number of images in the normal mode is desired to be lower than the frequency with which the patch detection ATR control adjusts the developer dispensing apparatus 11*a* during the same image forming operation, because the higher the frequency with which the patch detection ATR control is carried out, the more accurate the amount of toner charge, and therefore, the more accurate the condition set by the image density adjustment control for the formation of an electrostatic image.

In the first embodiment, the amount of the toner in a test-patch was detected after the transfer of the test-patch onto the recording medium conveyance belt 21. However, it may be detected while the test-patch is on the peripheral surface of the photosensitive drum 3*a*. Detecting the amount of the toner in a test-patch while the test-patch is on the photosensitive drum 3*a* makes it possible to avoid the problem that the transfer changes the test-patch in the amount of the toner. However, it requires that each photosensitive drum is provided with the optical sensor 41.

Also in the first embodiment, each image forming station was provided with the drum cleaning device, which was placed in the adjacencies of the photosensitive drum 3*a*. However, the present invention is also compatible with an image forming station having no drum cleaning device. For example, it is compatible with an image forming station provided with an auxiliary charge brush instead of the drum cleaning device. In the case of such an image forming station, the residual toner is charged by the auxiliary charge brush, and is removed by the developing device.

<Embodiment 2>

Figure 7:
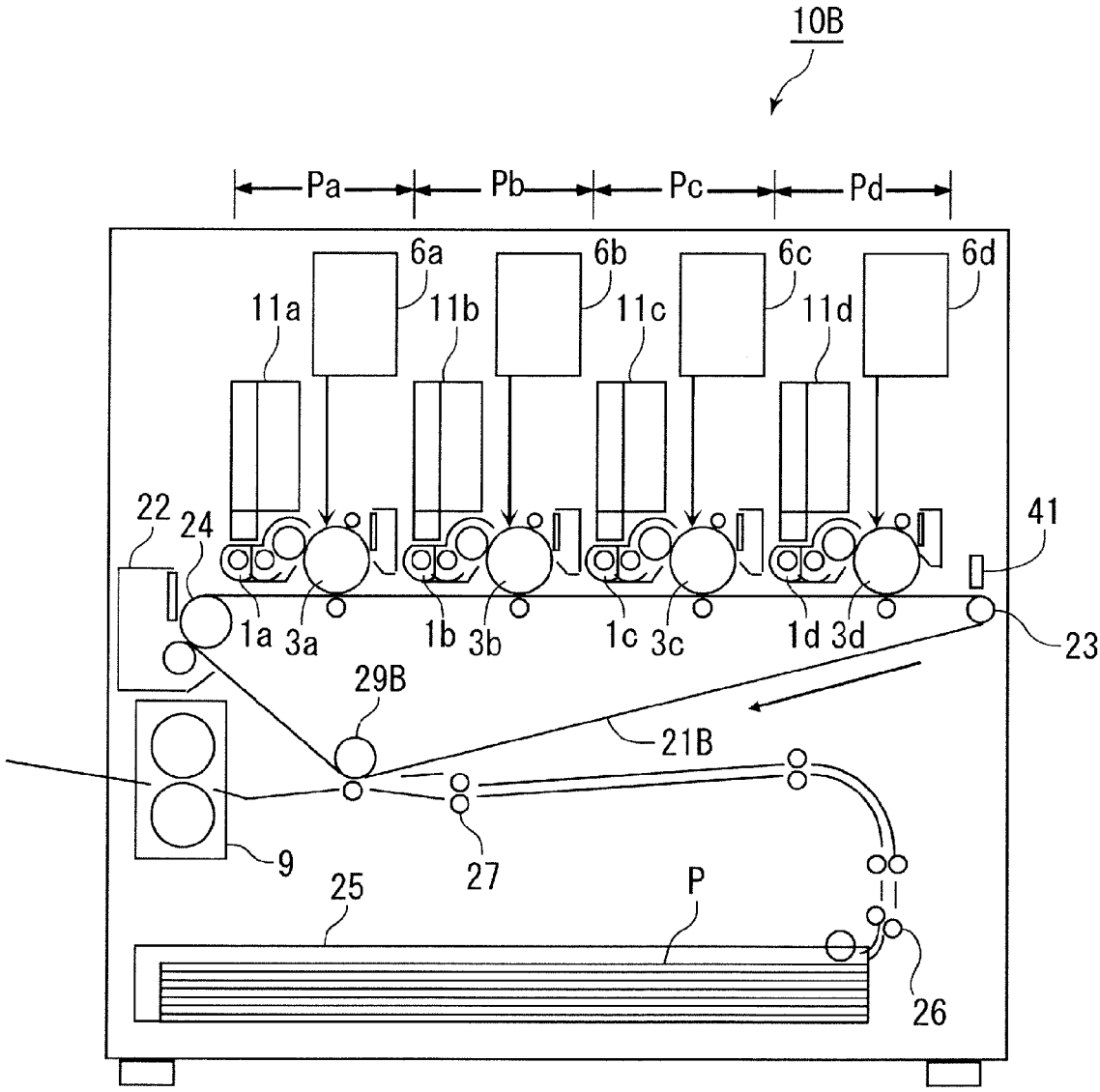
FIG. 7 is a schematic sectional view of the image forming apparatus in the second preferred embodiment of the present invention.

FIG. 7 is a drawing for describing the structure of the image forming apparatus 10B in the second preferred embodiment of the present invention. The image forming apparatus 10 in the first embodiment used the recording medium conveyance belt 21. The image forming apparatus in the second embodiment uses an intermediary transfer belt instead of the recording medium conveyance belt 21.

Referring to FIG. 7, the image forming apparatus 10B is a full-color printer of the tandem type, and employs an intermediary transfer belt 21B. The four image forming stations P, which are yellow, magenta, cyan, and black image forming stations Pa, Pb, Pc, and Pd are sequentially arranged in the listed order along the intermediary transfer belt 21B.

The image forming stations, Pa, Pb, Pc, and Pd form yellow, magenta, cyan, and black monochromatic images, respectively. Then, the four monochromatic toner images are sequentially transferred in layers (primary transfer) onto the intermediary transfer belt 21B, and then, are transfer together (secondary transfer) onto the sheet P of recording medium. The structural components of the image forming apparatus 10B are the same in structure as the counterparts of the image forming apparatus 10 in the first embodiment. Therefore, they are given the same referential code as that for the counterpart of the image forming apparatus 10, and are not going to be described here.

<Embodiment 3>

Figure 8:
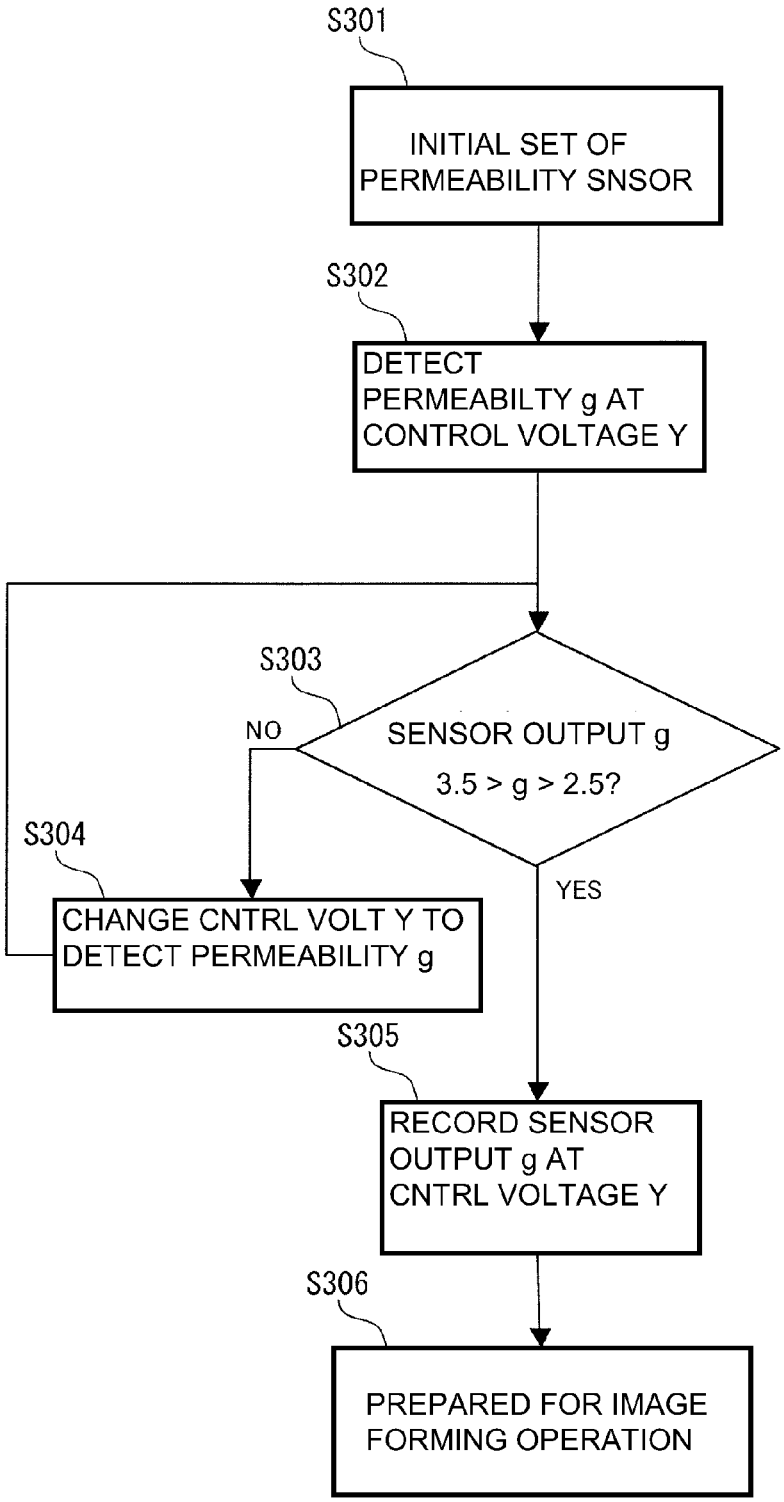
FIG. 8 is a flowchart of the control sequence for initializing the image forming apparatus for the patch detection ATR control (automatic toner replenishment), in the second preferred embodiment of the present invention.
Figure 9:
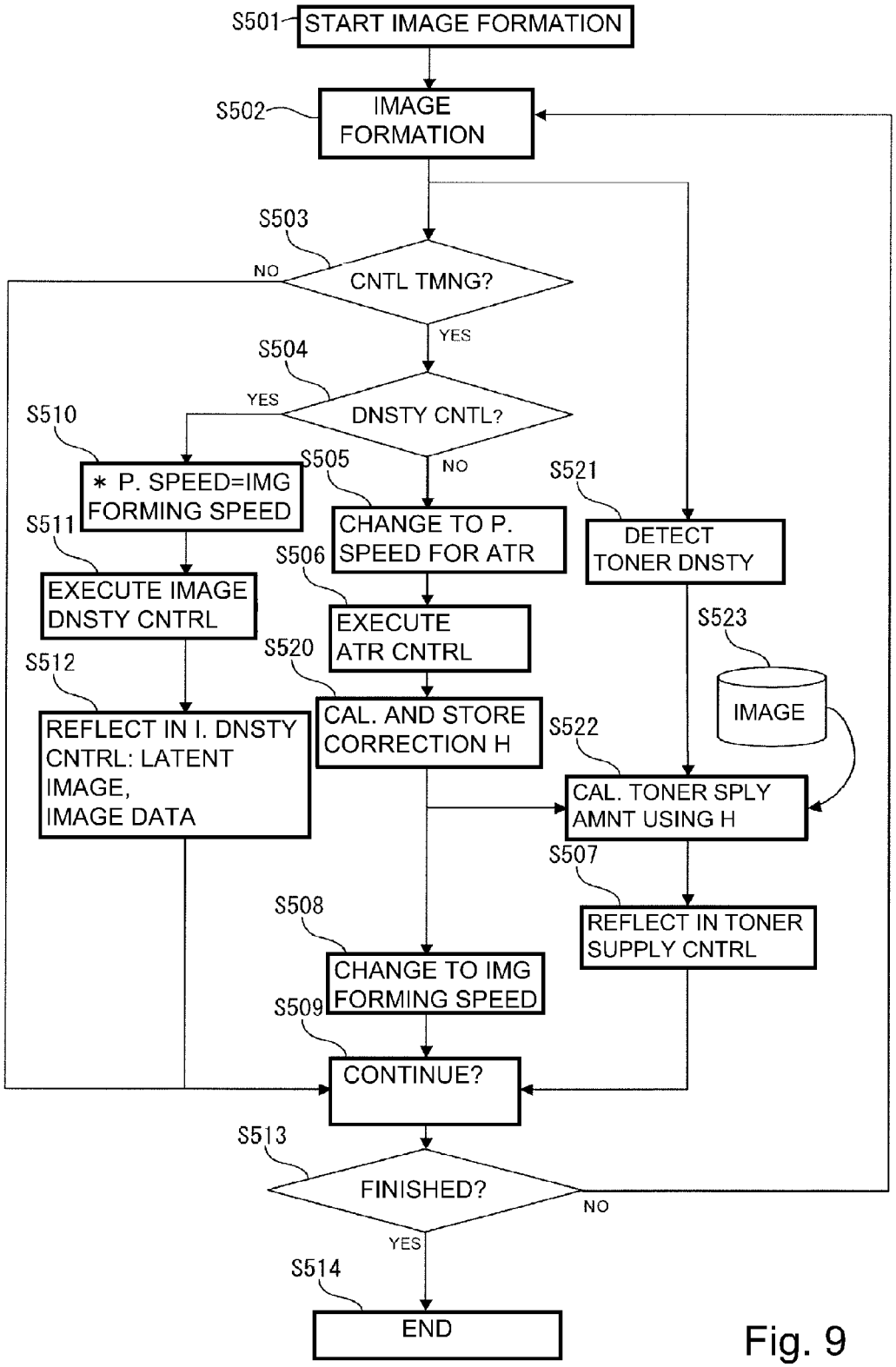
FIG. 9 is a flowchart of the patch detection ATR control (automatic toner replenishment) sequence in the third preferred embodiment, which is carried out by interrupting an ongoing image forming operation.

FIG. 8 is a flowchart of the initialization sequence for the patch detection ATR control in the third preferred embodiment of the present invention. FIG. 9 is a flowchart of the patch detection ATR control (automatic toner replenishment) sequence in the third preferred embodiment, which is carried out by interrupting an ongoing image forming operation. In the third embodiment, the initialization sequence is carried out for the patch detection ATR control even for the output of the permeability sensor 109.

Referring to FIG. 2, the permeability sensor 109 also is a means used for the patch detection ATR control. To the permeability sensor 109, a control voltage Y for measuring the permeability of the developer in the developing device 1*a* is applied, and the value g of the output of the permeability sensor 109 is detected. The control section 60 carries out the patch detection ATR control while reflecting the amount of the toner in a test-patch detected by the optical sensor 41, upon the referential value for the output of the permeability sensor 109.

Next, referring to FIG. 8 as well as FIG. 3, in the third embodiment, before the permeability sensor 109 is used for the first time in a given image forming operation, a control sequence for detecting the initial toner density with the use of the permeability sensor 109 is carried out, and the initial output value of the permeability sensor 109 is recorded as a target Vt. That is, as soon as the image forming apparatus 10B is turned on, the control section 60 begins to carry out the initialization sequence for the permeability sensor 109 (S301), and detects the value g of the output of the permeability sensor 109 while applying the control voltage V (S302).

It is in a range of 2.0 V-4.0 V that the permeability sensor 109 is excellent in sensitivity. Thus, the control section 60 determines whether or not the initial output value g of the permeability sensor 109 is in a range of 2.5 V-3.5 V (S303). If it determines that the output value g is within the range, the control section 60 records the initial output value g of the permeability sensor 109 in the RAM 62 (S305), and ends the initialization sequence for the patch detection ATR control. Then, the control section 60 prepares the image forming apparatus 10B for image formation (S304).

On the other hand, if the output value g is outside the desired range (No in S303), the control section 60 changes the control voltage Y (S304), and then, detects the output of the permeability sensor 109. That is, the control voltage Y is adjusted (S304) until the output value g falls within the preset range (YES in S303).

The output value g obtained through the above described sequence is used as the initial referential value, that is, a target value Vt, by the patch detection ATR control for which a continuous image forming operation is interrupted while it is being carried out. Hereinafter, the detected output value of the permeability sensor 109 is referred to as Vn.

Next, referring to FIG. 9 along with FIG. 3, in the third embodiment, the toner replenishment amount is controlled based the combination of the patch detection ATR control and the toner density adjustment control based on the output value g of the permeability sensor 109. As an image forming signal comes in, the control section 60 starts an image forming operation (S501), and begins to detect the toner density with the use of the permeability sensor 109 at roughly the same time (S521).

Then, the control section 60 compares the output value Vn with the referential target value Vt, and calculates the toner density Tv based on the output of the permeability sensor 109, using Equation (1):

$$Tv=A+B\times(Vt-Vn) \quad (1)$$

Tv: toner density based on output value of permeability sensor 109

A: coefficient based on initial toner density in developer

B: sensitivity coefficient per 1% of toner density based on sensitivity of permeability sensor 109.

Coefficient A is for compensating for such a situation that the toner changes in properties while the image forming apparatus 10B is in operation. It is usually 0.

If the control section 60 determines that the toner density Tv obtained using Equation (1) is less than the target value, it calculates a toner replenishment amount Th from the toner density Tv, using Equation (2), so that the toner density Tv converges to the target value.

$$Th=Tv\times C \quad (2)$$

Th: toner replenishment amount

C: coefficient for converting toner density 1% into toner replenishment amount.

The toner density detection by the permeability sensor 109 is carried out for the formation of every image, and the toner replenishment amount obtained by calculation based on the video counting method is adjusted according to the toner density detected by the permeability sensor 109. That is, the toner replenishment amount per print is obtained by adding the toner replenishment amount obtained based on the detected toner density, to the toner replenishment amount calculated by the video counting method. Generally, therefore, each image is formed after the developing device 1*a* is replenished with toner so that the target value Vt for the permeability sensor 109 and the value Vn detected by the permeability sensor 109 become roughly the same.

The control section 60 determines whether it is the recorded time for the patch detection ATR control or image density adjustment control, by looking up the data in the RAM 62 and ROM 63 while detecting the toner density with the use of the permeability sensor 109 (S503).

If it is the time for the image density adjustment control, the control section 60 sets the image formation speed of the image forming apparatus 10B to the same value as the one for the normal image formation speed as in the first embodiment (S510), and then, carries out the image density adjustment control (S511, S512). Then, it restarts the interrupted image forming operation (S509).

On the other hand, if it is the time for the patch detection ATR control, the control section 60 sets the image formation speed to the process speed for the initialization sequence for the patch detection ATR control (S505), and carries out the patch detection ATR control (S506).

Then, the control section 60 calculates the adjustment value H for the toner replenishment amount, from the results of the patch detection ATR control, changes the target value Vt for the permeability sensor 109 by the adjustment value H, and calculates the toner replenishment value Th, based on the new target value Vt (S522). When the control section 60 calculates the toner replenishment amount, it takes the video count (image information) into consideration as it does in the first embodiment (S523).

Next, the process (S522) in which the control section 60 calculates the adjustment value H for the toner replenishment amount, and adjusts the toner replenishment amount by the calculated adjustment value H, is described in detail.

The control section 60 compares the value Pn obtained in the patch detection ATR control, with the target value Pt for the patch detection ATR control, and calculates a toner density Tp, using Equation (3).

$$Tp=D+Ex(Pn-Pt) \quad (3)$$

Tp: toner density obtained based on the output of optical sensor 41

D: Coefficient based on initial target

E: Sensitivity coefficient per 1% of toner density based on the test-patch detection sensor sensitivity.

Coefficient D is for dealing with a case in which toner changes in properties, and/or the optical sensor 41 is replaced, during an image forming operation. Normally, it is 0. The initialization sequence for the patch detection ATR control, which concerns the optical sensor 41, in this embodiment is the same as the one in the first embodiment.

The control section 60 calculates the adjustment amount Vp for adjusting the target value Vp obtained with the use of the permeability sensor 109, by substituting the toner density Tp obtained using Equation (3), for a term Tp in Equation (4). In Equation (4), toner density Tp is multiplied by a conversion coefficient F for converting the toner density Tp into the target value for the permeability sensor 109.

$$Vp=F\times(G-Tp) \quad (4)$$

Vp: target adjustment amount

F: conversion coefficient for converting toner density into toner replenishment target amount.

The control section 60 calculates an offset V' for the permeability sensor target, by substituting the target adjustment amount (Vp) obtained using Equation (4), for a term Vt in Equation (5). In Equation (5), the target offset Vp for the toner replenishment amount is added to the target Vt for the peripheral surface 109.

$$Vt'=Vp+Vt \quad (5).$$

The adjustment amount H for the toner replenishment amount is used as a target offset value Vp by the patch detection ATR control to offset the target Vt for the permeability sensor 109. That is, the target Vt in Equation (1) is changed to target Vt' by the target adjustment amount Vp obtained with the use of Equation (5), and new target Vt' is stored in RAM 62. Therefore, the toner replenishment amount Th calculated based on the new target Vt is reflected upon the toner replenishment control (S507).

After carrying out the patch detection ATR control, the control section 60 switches the image formation speed back to the original speed, in order to restart the interrupted image forming operation (S508), and continues the image forming operation (S509). As for the target Vt for the permeability sensor 109, the new target Vt' upon which the target offset Vp obtained through the patch detection ATR control was reflected, is used until the next timing for the patch detection ATR control. After the toner replenishment amount Vh is calculated, and is reflected upon the toner replenishment amount control, the control section 60 makes the image forming apparatus 10B form the next image. Then, it determines whether or not the formed image is the last image to be formed (S513). If it is the last one, the control section 60 ends the image forming operation (S514). If it is necessary to continue the image forming operation (No in S513), the control section 60 forms the next image (S502). That is, the image formation sequence and its control in this embodiment, flow as described above.

In other words, in this embodiment, each time the patch detection ATR control is carried out, the target offset Vp is calculated, and the target Vt for the permeability sensor 109 is offset to the proper value Vt'.

The difference of the patch detection ATR control from the toner density adjustment control which uses the permeability sensor 109 is as follows. The permeability sensor 109 directly detects the toner density in the developing device 1*a*. In comparison, the patch detection ATR control calculates the toner density from the output (amount (per unit area) of toner in patch) of the optical sensor 41. That is, the toner density obtained through the patch detection ATR control reflects the developmental performance of the developing device 1*a*.

In the third embodiment, control is executed to directly adjust the developing device 1*a* in the target for the toner density of the developer in the developing device 1*a*. Therefore, the third embodiment is superior to the first embodiment in that it can more precisely keep the toner density in the developing device 1*a* in a range which is preset in the top and bottom limits.

In the third embodiment, a range is preset for the amount of offset for the target of the permeability sensor 109, and also, for the target for the permeability sensor 109. The third embodiment prevents by varying the toner density within a preset range, the problem that is caused by the excessive change in the toner density.

Incidentally, the coefficients in the equations given above include those which are to be determined in consideration of the data stored in the ROM 63 regarding the state of the apparatus, ambience, and image formation count.

<Embodiment 4>

The fourth preferred embodiment of the present invention is similar to the first embodiment. Only the difference in the fourth embodiment from the first one is that in order to further reduce an image forming operation in downtime, the image forming apparatus is enabled to operate in an image formation speed which is dedicated to the patch detection ATR control and is higher than the image formation speed for the normal mode.

The image forming apparatus in this embodiment also has multiple (four) photosensitive drums, which are in the so-called tandem arrangement so that patches are transferred onto the recording medium conveyance belt 21, that is, an example of a recording medium conveying member which is in the form a belt, as shown in FIG. 1. Next, referring to FIG. 4, the optical sensor 41 successively detects the amount of the toner in each of the multiple (four) test-patches after the test-patches are transferred onto the recording medium conveyance belt 21 from the multiple (four) photosensitive drums, one for one, so that they align in the moving direction of the recording medium conveyance belt 21.

In the fourth embodiment, the third image formation speed is higher than the highest image formation speed in which a toner image can be transferred onto a sheet of recording medium.

As described above, the patch detection ATR control to be carried out in the low speed mode can be made the same in the length of downtime as the patch detection ATR control to be carried out in the normal mode, by setting its test-patch formation speed to the test-patch formation speed for the patch detection ATR control for the normal mode. As long as the test-patch formation speed is the same as the image formation speed in which the initialization sequence for the patch detection ATR control is carried out to set the target, the output value d of the optical sensor 41 can be compared with the target, with no problem.

Thus, by setting the image (test-patch) formation speed for the patch detection ATR control to a value which is higher than the image formation speed for the normal mode, it is possible to make the length of downtime shorter than the length of downtime of the patch detection ATR control for the normal mode.

In the case of the image forming apparatus 10, the process speed which is highest in productivity is the image formation speed for the normal mode. It is such factors as the accuracy with which a sheet of ordinary paper can be conveyed, highest speed in which an unfixed toner image can be satisfactorily transferred onto a sheet of ordinary paper, and highest speed in which an unfixed toner image can be satisfactorily fixed to a sheet of ordinary paper by the fixing device 9, that determines the top limit for the process speed of the image forming apparatus 10. Therefore, as far as the formation and transfer of the test-patch (toner image) and the measurement of the amount of the toner in the test-patch are concerned, the process speed for the test-patch formation can be increased by several times compared to the process speed for the normal mode. That is, the patch detection ATR control and image density adjustment control in this embodiment do not involve a sheet P of recording medium. Therefore, they can be carried out at such a high speed.

In other words, the process speed for the patch detection ATR control and image density adjust control can be raised in the top speed limit, as long as the speed increase is limited to the period before the test-patch transfer onto the recording medium conveyance belt—21. In a case where the patch detection ATR control is carried out with the use of the recording medium conveyance belt 21, the speed in which a test-patch can be satisfactorily transferred onto a sheet of recording medium, and the speed in which an unfixed toner image can be satisfactorily fixed, do not need to be concerned with. Therefore, the image formation speed for the patch detection ATR control can be set to a higher speed than the process speed for the normal mode.

More concretely, in the fourth embodiment, the patch detection ATR control is carried out with the process speed set to 140% of the process speed for the normal mode. Needless say, the target is determined by carrying out the initialization sequence (FIG. 5) for the patch detection ATR control in the process speed dedicated to the patch detection ATR control.

By carrying out the patch detection ATR control in a process speed higher than the process speed for the normal mode, the downtime of 1.5 second, which is for the low speed mode in the first embodiment, which is given in Table 1, was reduced to 1.0 second. Further, the downtime of 1.5 second, which is for the normal mode, was also reduced to 1.0 second.

That is, not only can the fourth embodiment increase an image forming apparatus in productivity in the low speed mode, as in the first embodiment, but also, in the normal mode. That is, it can reduce an image forming apparatus in the length of time used for the patch detection ATR control, under various conditions in which an image forming apparatus is used, for example, in the low speed mode for the formation of high quality images, for the formation of a large number of images in the normal mode, with the use of various media. That is, the fourth embodiment can provide an image forming apparatus which is significantly higher in usability than any image forming apparatus which employs one of the conventional patch detection ATR control.

<Embodiment 5>

Not only is the present invention compatible with an image forming apparatus which employs an intermediary transferring member or a recording medium conveying member, but also, an image forming apparatus which conveys a sheet of recording medium without using a recording medium conveying member. In the case where the present invention is applied to an image forming apparatus which conveys a sheet of recording medium without using a recording medium conveying belt, the amount of the toner in a toner image is detected by an optical sensor while the toner image is still on the peripheral surface of the photosensitive drum, and the patch detection ATR control is carried out based on the thus obtained amount of the toner in the toner image.

The first controlling means forms a test-patch (toner image) for the image density adjustment control, in the first image formation speed, detects the amount of the toner in the test-patch, with the use of an optical sensor, and sets the condition for the formation of an electrostatic image in the first image formation speed. The second controlling means forms a test-patch (toner image) for the formation of the image density adjustment control in the second image formation speed which is higher than the first image formation speed, detects the amount of the toner in the test-patch, and sets the condition for the formation of an electrostatic image in the second image formation speed. The third controlling means forms a test-patch (toner image) for the toner charge amount adjustment in the third image formation speed, under a preset condition for the formation of an electrostatic image, detects the amount of the toner in the test-patch, and adjusts the developer dispensing device based on the detected amount of the toner in the test-patch.

According to the present invention, it is possible to provide an image forming apparatus which is significantly shorter in the length of the downtime attributable to the formation of a test-patch (toner image for control), and yet is no lower in the accuracy with which the image formation condition is adjusted, than any image forming apparatus in accordance with the prior art.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 246517/2010 filed Nov. 2, 2010 which is hereby incorporated by reference.

What is claimed is:

1. An image forming apparatus comprising:

an image forming portion for forming an image on a recording material, said image forming portion including a developing device for developing an electrostatic image formed on an image bearing member using a developer containing toner and a carrier;

a sensor for detecting a toner image formed by said image forming portion;

a correcting portion for correcting an image forming condition of said image forming portion on the basis of a result of detection, by said sensor, of a first control toner image formed by said image forming portion;

a supplying device for supplying the developer to said developing device;

a supply controller for controlling a supplying operation of said supplying device on the basis of a result of detection, by said sensor, of a second control toner image formed by said image forming portion;

an executing portion for executing an operation at least in a first image forming mode in which the image is formed at a first image forming speed and in a second image forming mode in which the image is formed at a second image forming speed which is lower than the first image forming speed; and a controller for controlling an image forming condition such that during execution of the operation at least in the second image forming mode, the first control toner image is formed at the image forming speed of the second image forming mode, and the second control toner image is formed after the image forming speed is changed to a third image forming speed which is higher than the second image forming speed.

2. An apparatus according to claim 1, wherein the third image forming speed is a maximum image forming speed of image forming speeds at which the image can be formed on the recording material.

3. An apparatus according to claim 1, wherein the third image forming speed is higher than a maximum image forming speed of image forming speeds at which the image can be formed on the recording material.

4. An apparatus according to claim 1, wherein said controller controls the image forming condition such that during the operation at least in the first image forming mode, the first control toner image and the second control toner image are formed at the image forming speed of the first image forming mode.

* * * * *